US008437657B2

(12) United States Patent
Kikuchi et al.

(10) Patent No.: US 8,437,657 B2
(45) Date of Patent: May 7, 2013

(54) CLEANING APPARATUS AND IMAGE FORMING APPARATUS

(75) Inventors: Hisashi Kikuchi, Kanagawa (JP); Kenji Sugiura, Kanagawa (JP); Osamu Naruse, Kanagawa (JP); Naomi Sugimoto, Kanagawa (JP); Yoshiki Hozumi, Kanagawa (JP); Yuu Sakakibara, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 226 days.

(21) Appl. No.: 12/955,320

(22) Filed: Nov. 29, 2010

(65) Prior Publication Data

US 2011/0158677 A1 Jun. 30, 2011

(30) Foreign Application Priority Data

Dec. 24, 2009 (JP) ..... 2009-293120

(51) Int. Cl.
*G03G 15/16* (2006.01)

(52) U.S. Cl.
USPC ..... 399/101; 399/71; 399/123; 399/343; 399/353; 399/354

(58) Field of Classification Search ..... 399/101, 399/123, 343, 353, 354
See application file for complete search history.

(56) References Cited

U.S. PATENT DOCUMENTS

| | | | | |
|---|---|---|---|---|
| 5,526,100 | A | 6/1996 | Misago et al. | |
| 5,592,267 | A | 1/1997 | Misago et al. | |
| 6,799,012 | B2 | 9/2004 | Shakuto et al. | |
| 6,987,944 | B2 | 1/2006 | Shakuto et al. | |
| 7,062,212 | B2 | 6/2006 | Naruse et al. | |
| 7,103,301 | B2 | 9/2006 | Watanabe et al. | |
| 7,123,872 | B2 | 10/2006 | Shakuto et al. | |
| 7,127,191 | B2 * | 10/2006 | Mori et al. | 399/101 |
| 7,184,699 | B2 | 2/2007 | Naruse et al. | |
| 7,209,699 | B2 | 4/2007 | Yamaguchi et al. | |
| 7,369,807 | B2 | 5/2008 | Naruse et al. | |
| 7,376,380 | B2 | 5/2008 | Koike et al. | |
| 7,415,236 | B2 | 8/2008 | Nakano et al. | |
| 7,415,238 | B2 | 8/2008 | Watanabe et al. | |
| 7,496,324 | B2 | 2/2009 | Sugiura et al. | |
| 7,505,728 | B2 | 3/2009 | Yamaguchi et al. | |
| 7,603,071 | B2 | 10/2009 | Sugiura et al. | |

(Continued)

FOREIGN PATENT DOCUMENTS

| | | |
|---|---|---|
| JP | 2002-202702 | 7/2002 |
| JP | 2007-025173 | 2/2007 |

*Primary Examiner* — David Gray
*Assistant Examiner* — Francis Gray
(74) *Attorney, Agent, or Firm* — Oblon, Spivak, McClelland, Maier & Neustadt, L.L.P.

(57) ABSTRACT

A cleaning apparatus including: a normally-charged toner cleaning member that receives a voltage having a polarity reverse to a normal charging polarity of a toner and electostatically removes a toner having the normal charging polarity on a cleaning target; a reversely-charged toner cleaning member that receives a voltage having the same polarity as the normal charging polarity of a toner and electrostatically removes a toner having a polarity reverse to the normal charging polarity on the cleaning target; and a pre-cleaning member that is disposed at an upstream side of the normally-charged toner cleaning member and the reverse-charged toner cleaning member in a surface moving direction of the cleaning target, receives a voltage having a polarity reverse to the normal charging polarity of the toner, and electrostatically removes a toner having the normal charging polarity on the cleaning target, is provided.

15 Claims, 7 Drawing Sheets

U.S. PATENT DOCUMENTS

| | | | | |
|---|---|---|---|---|
| 7,610,008 | B2 | 10/2009 | Watanabe et al. | |
| 7,620,357 | B2 | 11/2009 | Shakuto et al. | |
| 2006/0210300 | A1* | 9/2006 | Nishikawa | 399/101 |
| 2007/0059028 | A1* | 3/2007 | Nishikawa | 399/101 |
| 2007/0230994 | A1* | 10/2007 | Takishita | 399/101 |
| 2008/0131157 | A1* | 6/2008 | Shibuya et al. | 399/66 |
| 2008/0286020 | A1 | 11/2008 | Watanabe et al. | |
| 2009/0176669 | A1 | 7/2009 | Sugiura et al. | |
| 2009/0285589 | A1* | 11/2009 | Nishikawa | 399/43 |
| 2009/0311004 | A1* | 12/2009 | Naruse et al. | 399/101 |
| 2011/0025834 | A1* | 2/2011 | Chen et al. | 348/77 |
| 2011/0103822 | A1* | 5/2011 | Sugiura et al. | 399/101 |

* cited by examiner

CLEANING APPARATUS AND IMAGE FORMING APPARATUS

CROSS-REFERENCE TO RELATED APPLICATIONS

The present application claims priority to and incorporates by reference the entire contents of Japanese Patent Application No. 2009-293120 filed in Japan on Dec. 24, 2009.

BACKGROUND OF THE INVENTION

1. Field of the Invention

The present invention relates to a cleaning apparatus and an image forming apparatus.

2. Description of the Related Art

As a cleaning apparatus employed in an image forming apparatus such as a copy machine, a facsimile, and a printer, a blade cleaning technique that presses a cleaning blade against a circumferential surface of an image carrier as a cleaning target to scrape and remove a toner on the image carrier has been known. The blade cleaning technique is widely being used thanks to a simple structure and a stable performance.

In recent years, there has been an increasing demand for improvement in image quality. As a result, particles of a toner become more spherical and smaller in diameter to satisfy such demand. The smaller diameter can improve the accuracy, definition, and resolution of an image. On the other hand, the more spherical shape improves a development property and a transfer property of a toner. However, it is difficult to perform effective cleaning on the spherical toner having the small particle diameter through the general cleaning blade technique. This is because of the following reasons. That is, a cleaning blade removes a toner by rubbing an image carrier surface with its edge part, but the edge part of the cleaning blade deforms due to the frictional resistance with the image carrier. Due to a so-called stick-slip phenomenon, a tiny void is formed between the image carrier and the cleaning blade. As the toner has a smaller diameter, the toner can more easily intrude into the void. Further, as the shape of the intruding toner is closer to the spherical shape, the toner may more easily rolls in the void due to generation of a rotational moment of the toner. For this reason, the spherical toner having the small diameter easily sneaks into the void between the cleaning blade and the image carrier.

In the case of using the spherical toner having the small particle diameter, a technique of preventing toner sneaking by increasing force (linear pressure) of the cleaning blade that comes in press contact with the image carrier may be considered. However, if pressing force increased and a high load is applied, the image carrier or the cleaning blade gets worn, and a lifespan extremely gets shorter. In recent years, an apparatus having a long lifespan is required, and thus a problem related to such durability should be avoided.

Meanwhile, as a technique of effectively cleaning the spherical toner having the small particle diameter, there is an electrostatic cleaning technique. This technique electrostatically removes the toner from the image carrier by applying a voltage of a polarity reverse to a charging polarity of the toner to a cleaning member such as a conductive cleaning blade that comes into contact with the image carrier.

However, the toner may not be completely removed through the electrostatic cleaning technique. This is because the charging quantity of the residual transfer toner that arrives as the cleaning member is variable as will be described later. Most part of the toner on the image carrier before a transfer is charged to the normal charging polarity of the toner (a negative polarity in this description). In a transfer unit, the toner on the image carrier is transferred to a transferred body when receiving a transfer electric field having a polarity (a positive polarity) reverse to the normal charging polarity of the toner. However, the toner may adhere to the image carrier "as is" as the residual transfer toner. Charges having the positive polarity applied by the transfer unit are injected into the residual transfer toner, so that the charge quantity shifts toward the positive polarity. For this reason, the residual transfer toner on the image carrier has a broad charge distribution in which the toner having the positive polarity and the toner having the negative polarity are mixed. In the electrostatic cleaning technique, since cleaning is electrostatically performed when a voltage having a polarity reverse to the normal charging polarity of the toner is applied to the cleaning member, it is difficult to collect the toner shifted to the positive polarity.

Japanese Patent Application Laid-open No. 2002-202702 discloses a cleaning apparatus in which a conductive blade that comes into contact with the image carrier and receives a voltage having a polarity reverse to a cleaning brush is disposed as a polarity control means for adjusting the charging polarity of the toner at an upstream side of a cleaning brush that is a cleaning member. According to the cleaning apparatus disclosed in Japanese Patent Application Laid-open No. 2002-202702, the residual transfer toner receives charges injected from the conductive blade when it passes through a position at which the conductive blade abuts on the image carrier (a blade abutting position), so that the charging polarity of the toner is adjusted to the same polarity (typically, the normal charging polarity of the toner) as the conductive blade. As a result, the charging polarity of the toner, which has arrived at a position where the cleaning blade comes into contact with the image carrier (a roller contact position) after passing through the blade abutting position, is adjusted to any one polarity (the same polarity as the conductive blade). Thus, right after the transfer, even the toner charged to the polarity reverse to the corresponding polarity can be electrostatically collected by the cleaning blade.

Further, Japanese Patent Application Laid-open No. 2007-25173 discloses a cleaning apparatus having a first cleaning brush to which a voltage of the polarity (the positive polarity) reverse to the normal charging polarity of the toner is applied and a second cleaning brush to which a voltage of the same polarity as the normal charging polarity of the toner is applied and which is disposed at a downstream side of the first cleaning brush. According to the cleaning apparatus disclosed in Japanese Patent Application Laid-open No. 2007-25173, the toner having the normal charging polarity (the negative polarity) on the image carrier is electrostatically absorbed onto the first cleaning brush serving as a normally-charged toner cleaning member and removed from the image carrier. The toner having the polarity (the positive polarity) reverse to the normal charging polarity on the image carrier is electrostatically absorbed onto the second cleaning brush serving as a revere charged toner cleaning member and removed from the image carrier. As a result, the toner inclined toward the positive polarity and the negative polarity toner can be removed from the image carrier.

When a toner pattern is formed on the image carrier by the control for adjusting image density and/or for correcting a misalignment in color superposition of an image, the density is read by a photo sensor, and an image creation condition is controlled based on the detection result, the toner pattern that was read is not transferred to a transfer sheet but removed by the cleaning apparatus. Even in a mode of consuming the toner to refresh the toner inside the developer or even when a jam occurs due to a transportation failure of paper, the created toner image is not transferred to the transfer sheet but removed by the cleaning apparatus. As described above, the cleaning apparatus also removes a non-transferred toner image that is a large amount of toner adhering to the image carrier, for example, the toner pattern as well as the residual transfer toner.

In the cleaning apparatus disclosed in Japanese Patent Application Laid-open No. 2002-202702, there are occasions that all particles in a large amount of toner that forms the non-transferred toner image cannot be adjusted to any one polarity by the polarity control means and thus the toner having the same polarity as the polarity applied to the cleaning brush enters the roller contact position. Further, there are also different occasions that it is difficult to electrostatically absorb a large amount of toner that forms the non-transferred toner to the brush of the cleaning brush. Therefore, in the cleaning apparatus disclosed in Japanese Patent Application Laid-open No. 2002-202702, if the non-transferred toner that is a large amount of toner adhering to the image carrier is input, cleaning failure may occur.

In the cleaning apparatus disclosed in Japanese Patent Application Laid-open No. 2007-25173, the first cleaning brush has the large diameter, and the second cleaning brush has the small diameter. By increasing the diameter size of the first cleaning brush, the nip width of the first cleaning brush increases, and a time in which the bristle contacts the image carrier increases. Further, since the length of the bristle increases, the contact area between the bristle and the toner increases. As a result, the amount of the toner that can be electrostatically absorbed by the first cleaning brush increases. Accordingly, a large amount of toner having the normal charging polarity can be removed by the first cleaning brush. Since most part of a toner that forms the non-transferred toner image to be input to the cleaning apparatus has the normal charging polarity, a large amount of non-transferred toner can be removed by the first cleaning brush when the non-transferred toner image is input.

Through the second cleaning brush having the small diameter to which a voltage of the same polarity as the normal charging polarity of the toner is applied, the toner having the normal charging polarity remaining on the image carrier that could not be removed by the first cleaning brush is mechanically removed, and the toner having the polarity reverse to the normal charging polarity is removed mechanically and electrostatically. If the second cleaning brush has the small diameter, the capability of electrostatically removing the toner of the polarity reverse to the normal charging capacity gets deteriorated. However, since the length of the bristle is short, the mechanical removing capability is improved. For this reason, the toner having the normal charging polarity remaining on the image carrier that could not be removed by the first cleaning brush can be mechanically effectively removed by the second cleaning brush. Since a small amount of the toner having the polarity reverse to the normal charging polarity is present in the non-transferred toner image, even though the capability of electrostatically removing the toner of the polarity reverse to the normal charging polarity of the second cleaning brush gets deteriorated, the toner having the polarity reverse to the normal charging polarity that passed through the first cleaning brush can be removed electrostatically and effectively by the second cleaning brush. Further, since the mechanical removing capability improves, mechanically removing is also enabled. Therefore, even though the capability of electrostatically moving the toner of the polarity reverse to the normal charging polarity of the second cleaning brush gets deteriorated, the toner having the polarity reverse to the normal charging polarity can be effectively removed by the second cleaning brush. In this way, the cleaning apparatus disclosed in Japanese Patent Application Laid-open No. 2007-25173 can prevent cleaning failure when the non-transferred toner that is a large amount of toner adhering to the image carrier is input.

However, in the cleaning apparatus disclosed in Japanese Patent Application Laid-open No. 2007-25173, electrostatic force of a repulsive direction acts on the toner charged to the normal charging polarity in the second cleaning brush to which a voltage having the same polarity as the normal charging polarity of the toner is applied. For this reason, even though the mechanical removing capability of the second cleaning brush increases, the toner having the normal charging polarity may pass through between the bristles without abutting on the bristles of the second cleaning brush. Thus, the sufficient mechanical capability is not obtained, resulting in the cleaning failure. Further, when removing the residual transfer toner, there are occasions that a large amount of the toner having the polarity reverse to the normal charging polarity is present. In such occasions, the residual toner having the polarity reverse to the normal charging polarity may not be effectively removed by the second cleaning brush in which the capability of electrostatically absorbing and removing the toner gets deteriorated due to the small particle diameter. This results in the cleaning failure.

SUMMARY OF THE INVENTION

The present invention is derived in view of the above problems, and it is an object of the present invention to provide a cleaning apparatus and an image forming apparatus in which the non-transferred toner and the residual transfer toner can be effectively removed from the cleaning target.

According to an aspect of the present invention, there is provided a cleaning apparatus, comprising: a normally-charged toner cleaning member that receives a voltage having a polarity reverse to a normal charging polarity of a toner and electrostatically removes a toner having the normal charging polarity on a cleaning target; a reversely-charged toner cleaning member that receives a voltage having the same polarity as the normal charging polarity of a toner and electrostatically removes a toner having a polarity reverse to the normal charging polarity on the cleaning target; and a pre-cleaning member that is disposed at an upstream side of the normally-charged toner cleaning member and the reversely-charged toner cleaning member in a surface moving direction of the cleaning target, receives a voltage having a polarity reverse to the normal charging polarity of the toner, and electrostatically removes a toner having the normal charging polarity on the cleaning target.

According to another aspect of the present invention, there is provided a cleaning apparatus, comprising: a polarity control unit that controls a charging polarity of a toner on a cleaning target; a cleaning member that is disposed at a downstream side of the polarity control unit in a surface moving direction of the cleaning target, receives a voltage having a polarity reverse to the charging polarity of the toner controlled by the polarity control unit, and electrostatically removes the toner; and a pre-cleaning member that is disposed at an upstream side of the polarity control unit in the surface moving direction of the cleaning target, receives a voltage having a polarity reverse to the normal charging polarity of the toner, and electrostatically removes a toner having the normal charging polarity.

According to still another aspect of the present invention, there is provided a image forming apparatus that forms an image on a recording material by finally transferring a toner image formed on an image carrier from the image carrier to the recording material, comprising: either one of the cleaning apparatuses mentioned earlier is used as a cleaning apparatus for cleaning a residual transfer toner remaining on the image carrier after a transfer.

According to the first aspect of the invention, when the non-transferred toner image is input to the cleaning apparatus, a toner having the normal charging polarity that is the majority toner of toners that form the non-transfer toner image is roughly removed by a pre-cleaning member. Thus, the amount of toner to be input to a normally-charged toner cleaning member and a reversely-charged toner cleaning member is reduced. The remaining normally-charged toner that could not be removed by the pre-cleaning member is electrostatically removed by the normally-charged toner cleaning member, and the toner having the polarity reverse to the normal charging polarity is electrostatically removed by the reversely-charged toner cleaning member. Thus, the non-transferred toner image input to the cleaning apparatus can be effectively cleaned.

Further, since the toner having the normal charging polarity that could not be removed by the pre-cleaning member is electrostatically removed by the normally-charged toner cleaning member, the following effects can be obtained. As compared with the case in which the toner having the normal charging polarity that could not be completely removed by the pre-cleaning member is mechanically removed by the reversely-charged toner cleaning member as in the cleaning apparatus disclosed in Japanese Patent Application Laid-open No. 2007-25173, the toner having the normal charging polarity, on the cleaning target, that could not be completely removed by the pre-cleaning member can be effectively removed. Further, since the toner having the normal charging polarity that could not be completely removed by the pre-cleaning member does not need to be mechanically removed by the reversely-charged toner cleaning member, the reversely-charged toner cleaning member does not need to have the small diameter. Since the nip width of the reversely-charged toner cleaning member with the cleaning target can increase, even though a large amount of toner having a polarity reverse to the normal charging polarity is present on the cleaning target, the toner having a polarity reverse to the normal charging polarity can be effectively removed by the reversely-charged toner cleaning member. Even the residual transfer toner, of which the majority polarity of the toner is reverse to the normal charging polarity, can be effectively removed from the cleaning target.

According to the another aspect of the invention, when the non-transferred toner image is input to the cleaning apparatus, a toner having the normal charging polarity that is the majority of toners that form the non-transfer toner image is roughly removed by the pre-cleaning member. Thus, the amount of toner, on the cleaning target, to be input to a polarity control unit is reduced, and the toner, on the cleaning target, that passed through the pre-cleaning member can be effectively controlled to any one polarity by a charging polarity unit. Thus, the charging polarity of the toner to be input to the cleaning member is adjusted to any one polarity. Since the amount of toner is small, the toner on the cleaning target that could not be removed by the pre-cleaning member can be effectively removed by the cleaning member. As a result, the non-transferred toner image input to the cleaning apparatus can be effectively cleaned. Further, a small amount of residual transfer toner to be input to the cleaning apparatus can be effectively removed as in the conventional art.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
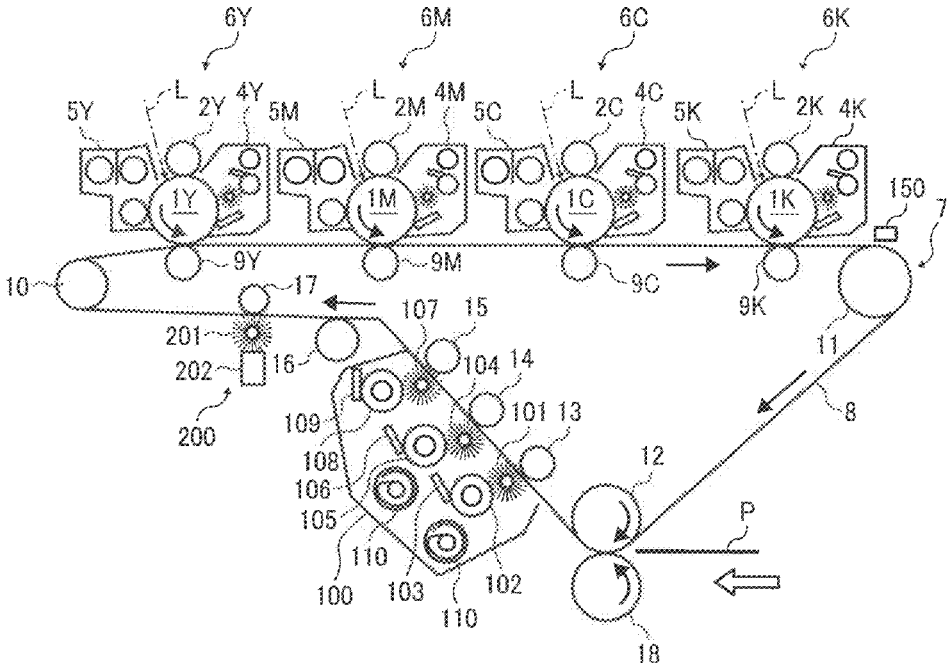
FIG. 1 is a schematic configuration view illustrating a main part of a printer according to an exemplary embodiment.

Hereinafter, as an exemplary embodiment of an image forming apparatus according to the present invention, a printer of a tandem intermediate transfer type (hereinafter, referred to as simply "printer") will be explained. First, a basic structure of the present printer will be explained. FIG. 1 is a schematic configuration view illustrating a main part of the printer. The printer includes four process units 6Y, 6M, 6C, and 6K for forming toner images of yellow, magenta, cyan, and black (hereinafter, referred to as "Y, M, C, and K"). The four process units 6Y, 6M, 6C, and 6K include drum-shaped photoreceptors 1Y, 1M, 1C, and 1K, respectively. Charging apparatuses 2Y, 2M, 2C, and 2K, developing apparatuses 5Y, 5M, 5C, and 5K, drum cleaning apparatuses 4Y, 4M, 4C, and 4K, and neutralizing apparatuses (not shown) are disposed around the photoreceptors 1Y, 1M, 1C, and 1K, respectively. The process units 6Y, 6M, 6C, and 6K have the same structure as each other but are different in using different color toners of Y, M, C, and K toners. An optical writing unit (not shown) for writing an electrostatic latent image by irradiating a laser beam L onto surfaces of the photoreceptors 1Y, 1M, 1C, and 1K are disposed above the process units 6Y, 6M, 6C, and 6K.

A transfer unit 7 serving as a belt apparatus having an intermediate transfer belt 8 of an endless belt shape that is a belt member is disposed below the process units 6Y, 6M, 6C, and 6K. In addition to the intermediate transfer belt 8, a plurality of stretching rollers disposed inside a loop of the belt member. In further addition, a secondary transfer roller 18 disposed outside the loop of the belt member, a tension roller 16, a belt cleaning apparatus 100, and a lubricant coating apparatus 200 are also disposed.

Four primary transfer rollers 9Y, 9M, 9C, and 9K, a driven roller 10, a driving roller 11, a secondary transfer facing roller 12, three cleaning facing rollers 13, 14, and 15, and a coating brush facing roller 17 are disposed inside the loop of the intermediate transfer belt 8. All of the rollers function as stretching rollers for stretching the belt by winding the intermediate transfer belt 8 around a part of the peripheral surface of each. The cleaning facing rollers 13, 14, and 15 do not need to necessarily have a function of applying a certain amount of tension as a requisite and may be driven and rotated by rotation of the intermediate transfer belt 8. The intermediate transfer belt 8 can be endlessly moved clockwise in the drawing by rotation of the driving roller 11 that is rotationally driven clockwise in the drawing by a driving means (not shown).

The intermediate transfer belt 8 is pinched between the four primary transfer rollers 9Y, 9M, 9C, and 9K disposed inside the belt loop and the photoreceptors 1Y, 1M, 10, and 1K. Therefore, Y, M, C, and K primary transfer nips in which the surface of the intermediate transfer belt 8 and the photoreceptors 1Y, 1M, 10, and 1K abut on each other are formed. A primary transfer bias having the polarity reverse to the polarity of the toner is applied to the primary transfer rollers 9Y, 9M, 9C, and 9K from a power source (not shown), respectively.

The intermediate transfer belt 8 is pinched between the secondary transfer facing roller 12 disposed inside the belt loop and the secondary transfer roller 18 disposed inside the belt loop. Therefore, a secondary transfer nip in which the front surface of the intermediate transfer belt 8 and the secondary transfer roller 18 abut on each other is formed. A secondary transfer bias having the polarity reverse to the polarity of the toner is applied to the secondary transfer roller 18 from a power source (not shown). Further, it may be configured such that a paper conveying belt is stretched by the secondary transfer roller, several support rollers, and the driving roller, and the intermediate transfer belt 8 and the paper conveying belt are pinched between the secondary transfer roller 18 and the secondary transfer facing roller 12.

Further, the intermediate transfer belt 8 is pinched between the three cleaning facing rollers 13, 14, and 15 disposed inside the belt loop and cleaning brush rollers 101, 104, and 107 of the belt cleaning apparatus 100 disposed outside the belt loop. Therefore, cleaning nips in which the surface of the intermediate transfer belt 8 and each of the cleaning rollers 101, 104, and 107 abut on each other are formed. The belt cleaning apparatus 100 is configured to be replaced together with the intermediate transfer belt 8. However, if the belt cleaning apparatus 100 and the intermediate transfer belt 8 are different in lifespan, the belt cleaning apparatus 100 may be attached to or detached from the printer body independently of the intermediate transfer belt 8. The belt cleaning apparatus 100 will be explained later in detail.

The present printer includes a paper feeding unit (not shown) that includes a paper feeding cassette for accommodating recording paper P and a paper feeding roller for feeding the recording paper P to a paper feeding path from the paper feeding cassette. A resist roller (not shown) that receives the recording paper sent from the paper feeding unit and feeds the recording paper toward the secondary nip at a predetermined timing, is disposed at the right side of the secondary transfer nip in the drawing. A fixing apparatus (not shown) that receives the recording paper P fed from the secondary transfer nip and performs a process of fixing a toner image onto the recording paper P, is disposed at the left side of the secondary transfer nip in the drawing. Y, M, C, and K toner supply apparatuses (not shown) for supplying Y, M, C, and K toners to the developing apparatuses 5Y, 5M, 5C, and 5K are disposed if necessary.

In recent years, as the recording paper, in addition to plain paper that was widely used in the past, special paper having a concave-convex portion as a design or special recording paper used for thermal transfer such as iron print is increasingly being used. If the special paper is used, as compared with the case of the conventional plain paper, the transfer failure easily occurs when the toner image obtained by superimposing color toners on the intermediate transfer belt 8 is secondary-transferred. Therefore, in the printer, an elastic layer having low hardness is formed on the intermediate transfer belt 8 and may deform along with the toner layer or the recording paper having poor smoothness at the transfer nip section. The surface of the intermediate transfer belt 8 can be made to deform in comply with the morphology of the local concave-convex portions by forming the elastic layer having low hardness on the intermediate transfer belt 8 and giving elasticity to the intermediate transfer belt 8. Therefore, even without excessively increasing transfer pressure applied to the toner layer, good adhesion is obtained and character missing does not occur during a transfer. Further, the transfer is uniformly performed even on the paper having poor smoothness. Furthermore, a transferred image having excellent uniformity can be obtained.

In the printer, the intermediate transfer belt 8 includes at least a base layer, an elastic layer, and a surface coating layer.

Examples of the material that is used in the elastic layer of the intermediate transfer belt 8 include an elastic member such as a thermosetting elastomer and a thermoplastic elastomer. Specifically, use may be made of one kind or two or more kinds selected from a group consisting of the thermosetting elastomer such as a butyl rubber, a fluorine-based rubber, an acrylic rubber, EPDM, NBR, acrylonitrile-butadiene-styrene rubber, a natural rubber, an isoprene rubber, a styrene-butadiene rubber, a butadiene rubber, an urethane rubber, syndiotactic 1,2-polybutadiene, an epichlorohydrin-based rubber, a polysulfide rubber, a polynorbornene rubber; and the thermoplastic elastomer such as, for example, polystyrene-based, polyolefin-based, polyvinyl chloride-based, polyurethane-based, polyamide-based, polyurea-based, polyester-based and fluorine resin-based elastomers. However, the material that is used in the elastic layer of the intermediate transfer belt 8 is not limited to the materials mentioned above.

The thickness of the elastic layer depends on the hardness and the layer structure, but is preferably in a range of 0.07 mm to 0.5 mm, and more preferably in a range of 0.25 mm to 0.5 mm. If the thickness of the intermediate transfer belt 8 is as thin as 0.07 mm or less, the pressure at the secondary transfer nip section against the toner on the intermediate transfer belt 8 increases, missing easily occurs during a transfer, and transfer efficiency of the toner gets deteriorated.

The hardness(HS) of the elastic layer is preferably in a range of $10° \leqq HS \leqq 65°$ (JIS-A). The optimum hardness depends on the thickness of the intermediate transfer belt 8, but if the hardness is lower than 10° JIS-A, missing is easy to occur during transfer. On the other hand, if the hardness is higher than 65° JIS-A, it is difficult to stretch the belt over the roller. Long-time stretching results in extension, leading to low durability and early replacement.

The base layer of the intermediate transfer belt 8 is made of a resin having small stretch. To be specific, as the material that is used for the base layer, use may be made of one kind or two or more kinds selected from a group consisting of polycarbonate; a fluorine resin (ETFE, PVDF and the like); a styrene resin (monomer or copolymer containing styrene or styrene substitution product) such as polystyrene, chloropolystyrene, poly-α-methyl styrene, styrene-butadiene copolymer, styrene-vinyl chloride copolymer, styrene-vinyl acetate copolymer, styrene-maleic acid copolymer, styrene-acrylic acid ester copolymer (styrene-methyl acrylate copolymer, styrene-ethyl acrylate copolymer, styrene-butyl acrylate copolymer, styrene-octyl acrylate copolymer and styrene-phenyl acrylate copolymer, etc.), styrene-methacrylic acid ester copolymer (styrene-methyl methacrylate copolymer, styrene-ethyl methacrylate copolymer, styrene-phenyl methacrylate copolymer, etc.), styrene-α-methyl chloroacrylate copolymer and styrene-acrylonitrile-acrylic acid ester copolymer; methyl methacrylate resin; butyl methacrylate resin; ethyl acrylate resin; butyl acrylate resin; modified acrylic resin (silicone-modified acrylic resin, vinyl chloride resin-modified acrylic resin, acrylic urethane resin, etc.); vinyl chloride resin; styrene-vinyl acetate copolymer; vinyl chloride-vinyl acetate copolymer; rosin-modified maleic acid resin; phenol resin; epoxy resin; polyester resin; polyester polyurethane resin; polyethylene; polypropylene; polybutadiene; polyvinylidene chloride; ionomer resin; polyurethane resin; silicone resin; ketone resin; ethylene-ethyl acrylate copolymer; xylene resin and polyvinyl butyral resin; polyamide resin; modified polyphenylene oxide resin and the like. However, the material that is used for the base layer is not limited to the materials mentioned above.

Further, a core layer that is composed of a material such as a canvas may be provided between the base layer and the elastic layer in order to prevent stretch of the elastic layer consisting of a material having large stretch such as a rubber. As the material that is used in the core layer to prevent stretch, use may be made of one kind or two or more kinds selected from a group consisting of, for example, a natural fiber such as cotton and silk; a synthetic fiber such as polyester fiber, nylon fiber, acrylic fiber, polyolefin fiber, polyvinyl alcohol fiber, polyvinyl chloride fiber, polyvinylidene chloride fiber, polyurethane fiber, polyacetal fiber, polyfluoroethylene fiber and phenol fiber; an inorganic fiber such as carbon fiber and glass fiber; and a metal fiber such as iron fiber and copper fiber, which is used in a yarn or a fabric cloth. Needless to say, the material that is used in the core layer is not limited to the materials mentioned above. The yarns mentioned above may be in any twisting type such as those twisted of one or multiple filaments, mono-fold yarn, multi-fold yarn, two-fold yarn, etc. Further, for example, fibers of the materials that are selected from the material group mentioned above may be subjected to mix-spinning. Needless to say, yarns may be used after they are subjected to appropriate conductive treatment. On the other hand, as the fabric cloth, fabric cloths of any texture such as the knit texture, etc. may be used, and needless to say, union cloth may be also used, and those subjected to conductive treatment may be also used.

The coat layer of the surface of the intermediate transfer belt 8 is for coating the surface of the elastic layer, and comprises a layer having good smoothness. A material that is used in the coat layer is not particularly limited, and generally a material that reduces adherence of a toner to the surface of the intermediate transfer belt 8 to elevate secondary transfer. As the material, for example, the following may be used: one kind or two or more kinds of polyurethane, polyester, epoxy resin, etc.; or one kind or two or more kinds of the resins such as polyurethane, polyester, epoxy resin, etc. in which one kind or two or more kinds of particles of materials that reduce surface energy to elevate lubricating property are dispersed. AS the materials of particles, for example, a fluorine resin, a fluorine compound, carbon fluoride, titanium oxide and silicon carbide, etc., or those of which the particle diameter is changed if necessary may be used. Further, those subjected to heat treatment in the same way as that of the fluorine-based rubber material to form a fluorine layer on the surface, whereby to reduce the surface energy, may be also used.

Further, if necessary, for the purpose of adjusting the resistance of the base layer, the elastic layer or the coat layer, these layer may include powders of conductive material such as, for example, carbon black, graphite, metal such as aluminum and nickel, conductive metal oxide such as tin oxide, titanium oxide, antimony oxide, indium oxide, potassium titanate, complex oxide of antimony oxide-tin oxide (ATO), complex oxide of indium oxide-tin oxide (ITO) and the like. Herein, the conductive metal oxide may be used in coating form on insulating particles such as barium sulfate particles, magnesium silicate particles, calcium carbonate particles, etc. However, the material for adjusting the resistance of the base layer, the elastic layer or the coat layer, is not limited to the materials mentioned above.

To the surface of the intermediate transfer belt 8, a lubricant is applied by a lubricant coating applicator 200 in order to protect the belt surface. The lubricant coating applicator 200 has a solid lubricant 202 such as an agglomerate of zinc stearate, and an application brush roller 201, which is an application member that abuts on the solid lubricant, and applies lubricant powders obtained by scratching out the solid lubricant by rotation, to the surface of the intermediate transfer belt 8.

When image information is received from, for example, a personal computer (PC), the printer rotationally drives the driving roller 11 to endlessly move the intermediate transfer belt 8. The stretching rollers excluding the driving roller 11 are driven and rotated by the belt. At the same time, the photoreceptors 1Y, 1M, 1C, and 1K of the process units 6Y, 6M, 6C, and 6K are rotationally driven. The surfaces of the photoreceptors 1Y, 1M, 1C, and 1K are uniformly charged by the charging apparatuses 2Y, 2M, 2C, and 2K, and at the same time, a laser beam L is irradiated to the charged surface to form electrostatic latent images. The electrostatic latent images formed on the surfaces of the photoreceptors 1Y, 1M, 1C, and 1K are developed by the developing apparatuses 5Y, 5M, 5C, and 5K, so that Y, M, C, and K toner images are formed on the photoreceptors 1Y, 1M, 1C, and 1K. The Y, M, C, and K toner images are primary-transferred in a superimposing manner onto the surface of the intermediate transfer belt 8 in the Y, M, C, and K primary transfer nips. As a result, the toner image in which four colors are superimposed is formed on the surface of the intermediate transfer belt 8.

Meanwhile, in the paper feeding unit (not shown), the recording paper P is fed from the paper feeding cassette by the paper feeding roller one after another and transported up to the resist roller pair. The resist roller pair is driven to send the recording paper P into the secondary transfer nip at timing in synchronization with the four-color-superimposed toner image on the intermediate transfer belt 8, and then the four-color-superimposed toner image on the belt is collectively secondary-transferred to the recording paper P. As a result, a full color image is formed on the surface of the recording paper P. The recording paper P on which the full color image is formed is transported from the secondary transfer nip to the fixing apparatus, and then a fixing process of the toner image is performed.

The cleaning process of the residual transfer toner is performed on the photoreceptors 1Y, 1M, 1C, and 1K, which have primary-transferred the Y, M, C, and K toner images onto the intermediate transfer belt 8, by the drum cleaning apparatus 4Y, 4M, 4C, and 4K. Thereafter, the photoreceptors 1Y, 1M, 1C, and 1K are neutralized by a neutralizing lamp and then uniformly charged by the charging apparatuses 2Y, 2M, 2C, and 2K to prepare next image formation. Further, the intermediate transfer belt 8 which has performed the primary transfer onto the recording paper P is subjected to the cleaning processing of removing residual transfer toner that is performed by the belt cleaning apparatus 100.

Figure 2:
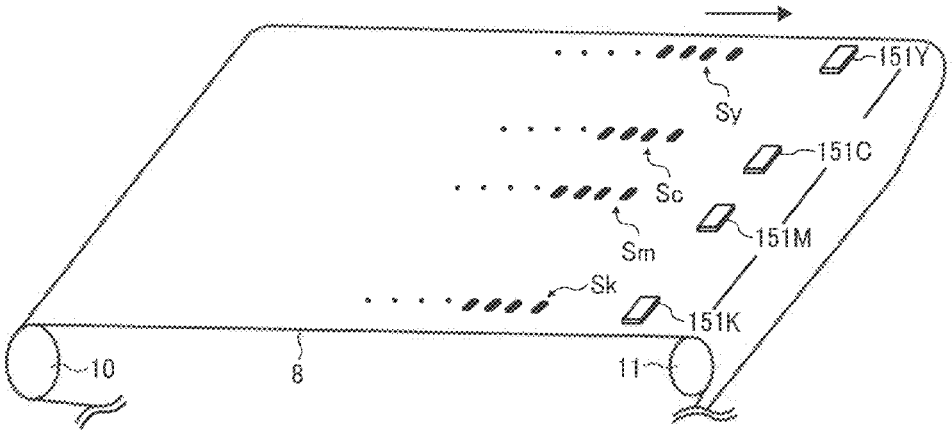
FIG. 2 is an enlarged schematic configuration view illustrating a gradation pattern and an optical sensor near an intermediate transfer belt.

At the right side of the process unit 6K in the drawing, an optical sensor unit 150 is disposed facing the surface of the intermediate transfer belt 8 with a predetermined gap therebetween. As illustrated in FIG. 2, the optical sensor unit 150 includes a Y optical sensor 151Y, a C optical sensor 151C, an M optical sensor 151M, and a K optical sensor 151K which are lined up in the width direction of the intermediate transfer belt 8. Each of the sensors includes a reflective type photo sensor. Light emitted from a light emitting apparatus (not shown) is reflected from the surface of the intermediate transfer belt 8 or the toner image on the belt, and an amount of reflected light is detected by a light receiving apparatus (not shown). Based on output voltage values from the sensors, a control unit (not shown) can detect the toner image on the intermediate transfer belt 8 and detect the image density (a toner adhesion amount per unit area).

In the printer, image density control for appropriately adjusting the image density of each color is performed at the time when power is supplied or a given number of printing jobs is performed.

For the image density control, as illustrated in FIG. 2, gradation patterns Sk, Sm, Sc, and Sy of the respective colors are automatically formed at positions on the intermediate transfer belt 8 facing the optical sensors 151Y, 151M, 151C, and 151K, respectively. The gradation pattern of each color includes ten toner patches, each having an area size of 2 cm×2 cm, the ten toner patches being different in image density. When forming the gradation patterns Sk, Sm, Sc, and Sy of the respective colors, the charging potential of each of the photoreceptors 1Y, 1M, 1C, and 1K is gradually increased unlike the uniform drum charging potential in the printer process. Plural patches of electrostatic latent images for forming the gradation pattern images are formed on the photoreceptors 1Y, 1M, 1C, and 1K, respectively, by irradiation of the laser beam and, at the same time, are developed by the developing apparatuses 5Y, 5M, 5C, and 5K for Y, M, C, and K. At the time of development, a value of a developing bias applied to each of the developing rollers for Y, M, C, and K is gradually increased. Through such development, Y, M, C, and K gradation pattern images are formed on the photoreceptors 1Y, 1M, 1C, and 1K. The Y, M, C, and K gradation pattern images are primary-transferred to be lined up at a predetermined interval in a main scanning direction of the intermediate transfer belt 8. At this time, the toner adhesion amount of the toner patch in the gradation pattern of each color is about 0.1 mg/cm$^2$ at minimum and 0.55 mg/cm$^2$ at maximum. When a toner-Q/d distribution is measured, it is found that the toner is adjusted to nearly the normal charging polarity.

Each of the toner patterns Sk, Sm, Sc, and Sy formed on the intermediate transfer belt 8 passes through a position facing the optical sensors 151K, 151M, 151C, and 151Y with endless movement of the intermediate transfer belt 8. At this time, each of the optical sensor 151 K, 151M, 151C, and 151Y receives a quantity of light corresponding to the toner adhesion amount per unit area on the toner patch of each gradation pattern.

Next, an adhesion amount in each toner patch of the toner pattern of each color is computed based on an adhesion conversion algorithm, and an output voltage of the optical sensor 151 that is obtained when the toner patch of each color is detected. An image creation condition is adjusted based on the computed adhesion amount. Specially, the computation is performed by regression analysis of a function (y=a×b) representing a straight line graph based on a result of detecting the toner adhesion amount in the toner patch and development potential at the time of creating each toner patch. An appropriate developing bias value is computed by assigning a target value of the image density to the function to specify developing biases for Y, M, C, and K.

A memory in the printer stores an image creation condition data table in which tens of developing bias values are individually associated with appropriate corresponding drum charging potentials, respectively. With respect to each of the process units 6Y, 6M, 6C, and 6K, developing bias values closest to the specified developing biases are respectively selected from the image creation condition table, and the drum charging potentials associated with them are specified.

Figure 3:
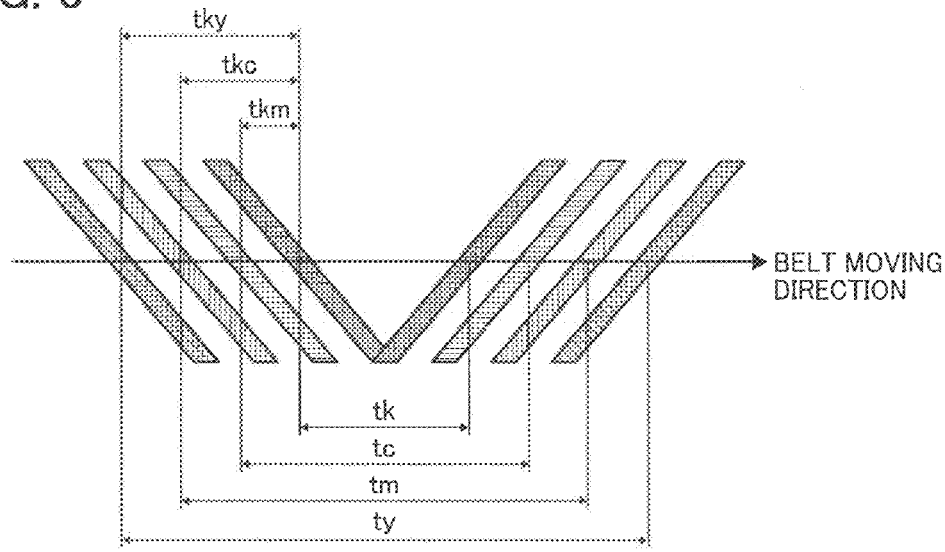
FIG. 3 is an enlarged schematic view illustrating a chevron patch formed on the intermediate transfer belt.

Further, in the printer, a color misalignment correction process is also performed at each time when power is supplied or when a given number of printing jobs is performed. In the color misalignment correction process, images for color misalignment detection including the toner images of the Y, M, C, and K colors called a chevron patch PV illustrated in FIG. 3 are formed on one end and the other end of the width direction of the intermediate transfer belt 8, respectively. As illustrated in FIG. 3, the chevron patch PV is a group of line patches in which the toner images of the Y, M, C, and K colors are inclined at about 45° to a main scanning direction and lined up with a predetermined pitch in the belt moving direction that is a sub scanning direction. The adhesion amount of the chevron patch PV is about 0.3 mg/cm$^2$.

By detecting each color toner image inside the chevron patches PV, respectively, formed at both ends of the width direction of the intermediate transfer belt 8, a position of the main scanning direction (a photoreceptor axis line direction) in each color image, a position of the sub scanning direction (the belt moving direction), an magnification error of the main scanning direction, and a skew from the main scanning direction are detected, respectively. The main scanning direction is referred to as a direction in which laser light phases at the photoreceptor surface with reflection by a polygon mirror. A detection time difference between the Y, M, and C toner images in the chevron patch PV and the K toner image is read by the optical sensor 151. In FIG. 3, an up-down direction on the paper plane corresponds to the main scanning direction, and the Y, M, C, and K toner images are lines up in order from the left. The K, C, M, and Y toner images that are 90° different in posture from the Y, M, C, and K toner images are lined up again. In FIG. 3, tk represents the detection time difference between the left side K toner image and the right side K toner image, tc represents the detection time difference between the left side C toner image and the right side C toner image, tm represents the detection time difference between the left side M toner image and the right side M toner image, and ty represents the detection time difference between the left side Y toner image and the right side Y toner image. Based on differences between actual measured values and theoretical values on the detection time differences tky, tkm, and tkc with K that is a reference color, a misalignment amount of the sub scanning direction of each color toner image, that is, a resist misalignment amount is computed. Based on the resist misalignment amount, at a one polygon mirror surface interval of the optical writing unit (not shown), that is, in units of scanning line pitches, optical writing start timing on the photoreceptor 1 is corrected to reduce resist misalignment of each color toner image. Further, based on the difference of sub scanning direction misalignment between both belt ends, an inclination (a skew) from the main scanning direction of each color toner image is computed. Based on the result, plane tilt correction of an optical system reflective mirror is performed to reduce the skew of each color toner image. As described above, a process of reducing resist misalignment or skew misalignment by correcting optical writing start timing and the plane tilt based on timing at which each toner image in the chevron patch PV is detected is the color misalignment correction process. Through the color misalignment correction process, it is possible to prevent color misalignment of an image from occurring because the formation position of the each color toner image with respect to the intermediate transfer belt 8 is misaligned with time due to, for example, temperature change.

Further, if an image forming operation of a small image area is continued, since old toners staying in the developing apparatus for a long time increase, a toner charging characteristic gets deteriorated, and if it is used for image formation, the quality of an image gets deteriorated (developing capability deterioration and transfer characteristic deterioration). In order to prevent the old toner from staying in the developing apparatus, a refresh mode for refreshing the inside of the developing apparatus by ejecting the old toner to a non-image area of the photoreceptor 1 at regular timing and supplying a new toner to the developing apparatus that has low toner concentration after ejection is provided.

The control unit (not shown) stores a toner consumption amount of each of the developing apparatuses 5Y, 5M, 5C, and 5K and an operation time of each of the developing apparatuses 5Y, 5M, 5C, and 5K and checks whether or not the toner consumption amount on an operation time of a predetermined period of the developing apparatus is equal to or less than a threshold amount at a predetermined timing with respect to each developing apparatus. The control unit executes the refresh mode on the developing apparatus determined as equal to less than the threshold amount.

When the refresh mode is executed, a toner consumption pattern is formed on the non-image formation area of the photoreceptor corresponding to between papers and transferred onto the intermediate transfer belt 8. An adhesion amount of the toner consumption pattern is determined based on the toner consumption amount on an operation time of a predetermined period of the developing apparatus, and a maximum adhesion amount per unit area may be about 1.0 $mg/cm^2$. Further, if the toner Q/d distribution of the toner consumption pattern transferred onto the intermediate transfer belt 8 is measured, it is adjusted to nearly the normal charging polarity.

Each color gradation pattern, the chevron patch, and the toner consumption pattern formed on the intermediate transfer belt 8 are collected by the belt cleaning apparatus 100. At this time, the belt cleaning apparatus 100 should remove a large amount of toner from the intermediate transfer belt 8. However, in the conventional cleaning apparatus including the polarity control means and the brush roller or the conventional cleaning apparatus including the brush roller for removing the toner having the positive polarity and the brush roller for removing the toner having the negative polarity, it was difficult to remove the non-transferred toner image such as each color gradation pattern, the chevron patch, and the toner consumption pattern at once. In this case, the toner on the intermediate transfer belt 8 that was not completely cleaned was transferred onto the recording paper at the time of a next print operation, leading to an abnormal image.

The belt cleaning apparatus 100 of the present printer is configured to be able to remove the non-transferred toner image such as each color gradation pattern, the chevron patch, and the toner consumption pattern at once, which will be explained below in detail.

Figure 4:
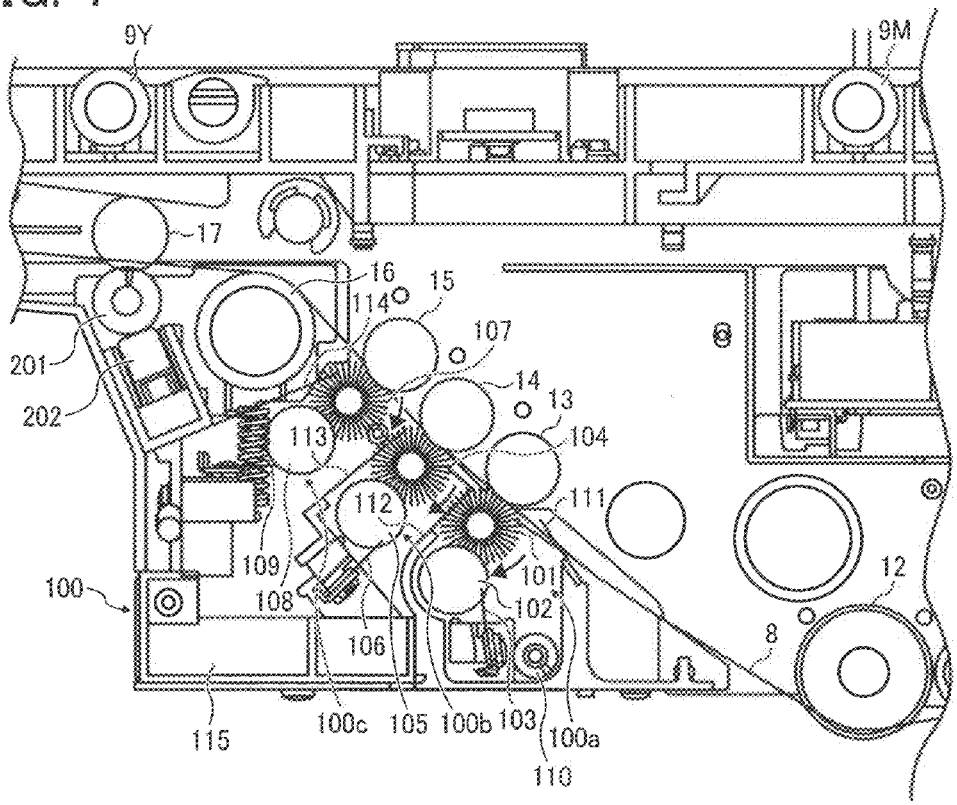
FIG. 4 is an enlarged configuration view enlarging and illustrating a belt cleaning apparatus of the printer and a periphery thereof.

FIG. 4 is an enlarged structure view illustrating the belt cleaning apparatus 100, in an enlarging manner that is a feature point of the present printer and the periphery thereof.

In FIG. 4, the belt cleaning apparatus 100 includes a pre-cleaning unit 100*a* for roughly removing the non-transferred toner image on the intermediate transfer belt 8, a reversely-charged toner cleaning unit 100*b* for removing the toner, on the intermediate transfer belt 8, charged to the polarity (the positive polarity) reverse to the normal charging polarity (the negative polarity), and a normally-charged toner cleaning unit 100*c* for removing the toner, the intermediate transfer belt 8, charged to the normal charging polarity.

The pre-cleaning unit 100*a* includes a pre-cleaning brush roller 101 that is a pre-cleaning member. The pre-cleaning unit 100*a* further includes a pre-collecting roller 102 as a pre-collecting member for collecting the toner adhered to the pre-cleaning brush roller 101 and a pre scraping blade 103 as a pre scraping member that abuts on the pre-collecting roller 102 and scrapes the toner from the roller surface.

Since most of the toners that form the non-transferred toner image are charged to the normal charging polarity (the negative polarity), a voltage having the polarity reverse to the normal charging polarity is applied to the pre-cleaning brush roller 101 to electrostatically remove the negative polarity toner on the intermediate transfer belt 8. A voltage having the positive polarity higher than one applied to the pre-cleaning brush roller 101 is applied to the pre-collecting roller 102. In the present belt cleaning apparatus 100, a voltage applied to the pre-cleaning brush roller is set so that 90% of the non-transferred toner images can be removed by the pre-cleaning brush roller 101.

The pre-cleaning unit 100*a* further includes a conveying screw 110 as a conveying unit for conveying the waste toner to a waste toner tank (not shown) included in the image forming apparatus body.

The reversely-charged toner cleaning unit 100*b* is disposed at a downstream side of the pre-cleaning unit 100*a* in the intermediate transfer belt 8 moving direction. The reversely-charged toner cleaning unit 100*b* includes a reversely-charged toner cleaning brush roller 104 as a reversely-charged toner cleaning member for electrostatically removing the toner charged to the polarity (the positive polarity) reverse to the normal charging polarity (the negative polarity) of the toner. The reversely-charged toner cleaning unit 100*b* further includes a reversely-charged toner collecting roller 105 as a reversely-charged toner collecting member for collecting the reversely-charged toner adhered to the reversely-charged toner cleaning brush roller 104 and a reversely-charged toner scraping blade 106 as a reversely-charged toner scraping member that abuts on the reversely-charged toner collecting roller 105 and scrapes the reversely-charged toner from the roller surface. A voltage having the negative polarity is applied to the reversely-charged toner cleaning brush roller 104, and a voltage having the negative polarity higher than one applied to the reversely-charged toner cleaning brush roller 104 is applied to the reversely-charged toner collecting roller 105. The reversely-charged toner cleaning unit 100*b* has a function as a polarity control unit for applying charges having the negative polarity to the toner on the intermediate transfer belt 8 and adjusting the charging polarity of the toner on the intermediate transfer belt 8 to the normal charging polarity (the negative polarity).

The normally-charged toner cleaning unit 100*c* is disposed at a downstream side of the reversely-charged toner cleaning unit 100*b* in the intermediate transfer belt 8 moving direction. The normal charging toner cleaning unit 100*c* includes a normally-charged toner cleaning brush roller 107 as a normally-charged toner cleaning member for electrostatically removing the toner charged to the normal charging polarity. The normally-charged toner cleaning unit 100*c* further includes a normally-charged toner collecting roller 108 as a normally-charged toner collecting member for collecting the normally-charged toner adhered to the normally-charged toner cleaning brush roller 107 and a normally-charged toner scraping blade 109 as a normally-charged toner scraping member that abuts on the normally-charged toner collecting roller 108 and scrapes the normally-charged toner from the roller surface. A voltage having the positive polarity is applied to the normally-charged toner cleaning brush roller 107, and a voltage having the negative polarity higher than one applied to the normally-charged toner cleaning brush roller 107 is applied to the normally-charged toner collecting roller 108.

The pre-cleaning unit 100*a* and the reversely-charged toner cleaning unit 100*b* are partitioned by a first insulating seal member 112. The first insulating seal member 112 abuts on the pre-cleaning brush roller 101. Since the pre-cleaning unit 100*a* and the reversely-charged toner cleaning unit 100*b* are partitioned by the first insulating seal member 112, it is possible to prevent discharging between the pre-cleaning brush roller 101 and the reversely-charged toner cleaning brush roller 104 from occurring and the toner removed by the reversely-charged toner cleaning unit 100*b* from being adhered to the pre-cleaning brush again.

The reversely-charged toner cleaning unit 100*b* and the normally-charged toner cleaning unit 100*c* are partitioned by a second insulating seal member 113. The second insulating seal member 113 abuts on the reversely-charged toner cleaning brush roller 104. Since the reversely-charged toner cleaning unit 100*b* and the normally-charged toner cleaning unit 100*c* are partitioned by the second insulating seal member 113, it is possible to prevent discharging between the reversely-charged toner cleaning brush roller 104 and the normally-charged toner cleaning brush roller 107 from occurring and the toner removed by the normally-charged toner cleaning unit 100*c* from being adhered to the reversely-charged toner cleaning brush roller 104 again.

In an outlet section of the belt cleaning apparatus 100, a third insulating seal member 114 that abuts on the normally-charged toner cleaning brush roller 107 is disposed. This can prevent discharging between the normally-charged toner cleaning brush roller 107 and the tension roller 16 from occurring.

The belt cleaning apparatus 100 further includes an inlet seal 111 and a waste toner case 115. The waste toner case 115 retains the toner removed by the reversely-charged toner cleaning unit 100*b* and the normally-charged toner cleaning unit 100*c*. The waste toner case 115 is detachably mounted to the belt cleaning apparatus 100. At the time of maintenance, the waste toner case 115 is detached from the belt cleaning apparatus 100, so that the toner retained in the waste toner case 115 can be removed.

In the present belt cleaning apparatus 100, the toner removed by the reversely-charged toner cleaning unit 100*b* and the normally-charged toner cleaning unit 100*c* is retained in the waste toner case 115, but the present invention is not limited thereto. For example, a conveying member for conveying the toner to the conveying screw 110 may be disposed on the bottom of the belt cleaning apparatus 100, or the bottom may have an inclined surface toward the conveying screw 110. In this case, the toner removed by the reversely-charged toner cleaning unit 100*b* and the normally-charged toner cleaning unit 100*c* may be conveyed to the waste toner tank (not shown) disposed in the image forming apparatus body by the conveying screw 110. Separately from the conveying screw, a second conveying screw for conveying the toner removed by the reversely-charged toner cleaning unit 100*b* and the normally-charged toner cleaning unit 100*c* to the waste toner (not shown) disposed in the image forming apparatus body may be disposed.

Each of the cleaning brush rollers 101, 104, and 107 includes a rotation shaft member that is made of metal and rotatably supported and a brush unit including a plurality of bristles erected on the peripheral surface thereof, and has the outer diameter of ϕ 15 mm to 16 mm. The bristle has a core-sheath structure of a dual-layer structure in which the inside is made of a conductive material such as conductive carbon and the surface is made of an insulating material such as polyester. The core has almost the same electric potential as a voltage applied to the cleaning brush roller and can electrostatically pull the toner to the bristle surface. As a result, the toner on the intermediate transfer belt 8 is electrostatically adhered to the bristle by an action of a voltage applied to the cleaning brush roller. The bristle of each of the cleaning brush rollers 101, 104, and 107 may include only conductive fiber. The bristle may be a so-called inclined bristle that is transplanted to be inclined to a normal line of the rotation shaft member. Further, the bristles of the pre-cleaning brush roller 101 and the normally-charged toner cleaning brush roller 107 may have the core-sheath structure, and the bristles of the reversely-charged toner cleaning brush roller 104 may be configured only with the conductive fiber. If the bristles of the reversely-charged toner cleaning brush roller 104 are configured only with the conductive fiber, charges are easily injected from the reversely-charged toner cleaning brush roller 104 to the toner. Therefore, the toner on the intermediate transfer belt 8 can be effectively adjusted to the negative polarity by the reversely-charged toner cleaning brush roller 104. If the bristles of the pre-cleaning brush roller 101 and the normally-charged toner cleaning brush roller 107 have the core-sheath structure, charges are prevented from being injected into the toner, thereby preventing the toner on the intermediate transfer belt 8 from being charged to the positive polarity. Therefore, a phenomenon in which the toner cannot be electrostatically removed can be prevented by the pre-cleaning brush roller 101 and the normally-charged toner cleaning brush roller 107.

Each of the cleaning brush rollers 101, 104, and 107 bites into the intermediate transfer belt 8 by 1 mm and rotates to move the bristle at an abutting position in a direction (a counter direction) reverse to the moving direction of the intermediate transfer belt 8 by a driving means (not shown). By rotation for moving the bristle in the counter direction at the abutting position, a linear velocity difference between the cleaning brush roller and the intermediate transfer belt 8 can be increased. This increases the contact probability with the bristle while a certain spot of the intermediate transfer belt 8 passes through an abutting range on the cleaning brush roller, and thus the toner can be effectively removed from the intermediate transfer belt 8.

In the present belt cleaning apparatus 100, a stainless steel (SUS) roller is used as each of the collecting rollers 102, 105, and 108. Each of the collecting rollers 102, 105, and 108 may be made of any material if a function of dislocating the toner adhered to the cleaning brush roller from the brush to the collecting roller by a potential gradient between the bristle and the collecting roller is exerted. For example, each of the collecting rollers 102, 105, and 108 may have roller resistance of logR=12Ω to 13Ω by covering a conductive cored bar with a high resistance elastic tube of several μm to 100 μm, or performing further insulation coating. If the SUS roller is used as each of the collecting rollers 102, 105, and 108, there are merits of being capable to reduce the cost or the applied voltage, leading to saving energy. If the roller resistance is logR=12Ω to 13Ω, charge injection into the toner is prevented when collected by the collecting roller, and the toner becomes the same polarity as the polarity of the applied voltage of the collecting roller. Therefore, it is possible to prevent the toner collecting efficiency from being lowered.

Next, an arrangement relationship between the cleaning brush rollers 101, 104, and 107 and the cleaning facing rollers 13, 14, and 15 will be explained. In each of the cleaning units 100*a*, 100*b*, and 100*c*, an arrangement relationship between the cleaning brush roller and the cleaning facing roller is the same. Thus, the below description will be given in connection with an arrangement relationship between the pre-cleaning brush roller 101 and the cleaning facing roller 13 as an example.

Figure 5:
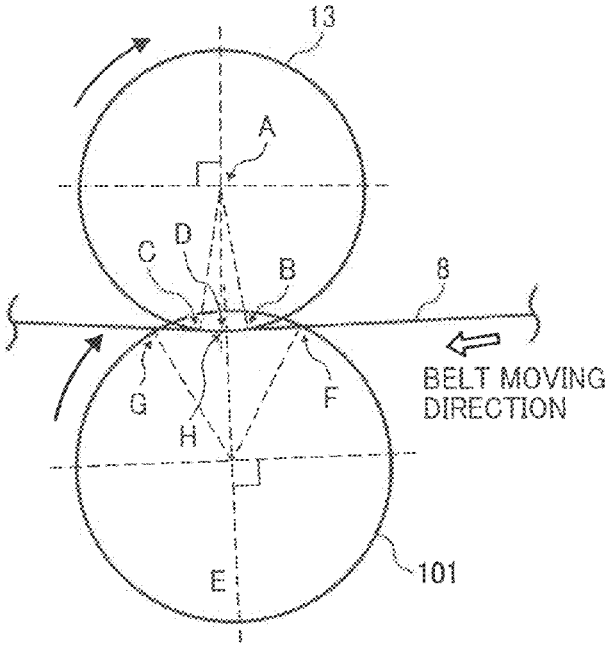
FIG. 5 is a view for explaining an arrangement of a cleaning facing roller and a pre-cleaning brush roller in the printer.

FIG. 5 illustrating an arrangement of the pre-cleaning brush roller 101 and the cleaning facing roller 13. In FIG. 5, the moving direction of the intermediate transfer belt 8 is a right-left direction in the drawing. The cleaning facing roller 13 is an aluminum roller of ϕ 14 mm and is driven and rotated by frictional force between the intermediate transfer belt 8 and the surface thereof. The cleaning facing roller 13 is connected to the earth. Of the whole circumference of the cleaning facing roller 13, an arc-shaped area from a point B to a point C in the drawing (hereinafter, referred to as "facing nip") is wounded by the intermediate transfer belt 8. In FIG. 5, a point A represents a central point of the cross section of the cleaning facing roller 13, and a point D represents a central point of the belt moving direction in the facing nip. The pre-cleaning brush roller 101 contacts the surface of the intermediate transfer belt 8 in an area from a nip inlet point F to a nip outlet point G (hereinafter, referred to as "brush nip"). A point H in FIG. 5 represents a central point of the brush nip in the belt moving direction, and E represents a straight line passing through the point H and the central point of the pre-cleaning brush roller 101. In the present belt cleaning apparatus 100, as illustrated in FIG. 5, positions of the point D and the point H are coincident with each other via the belt.

The condition of each of the cleaning brush rollers 101, 104, and 107 is as follows:

a brush material: conductive polyester (a so-called core-sheath structure in which the fiber inside includes conductive carbon and the fiber surface is polyester);

a brush resistance: $10^{6\ to\ 8}$Ω;

an applied voltage V of a rotation shaft member the pre-cleaning brush roller: +1600 to +2000 V reversely-charged toner cleaning brush roller: −2000 to −2400 V the normally-charged toner cleaning brush roller: 800 to 1200 V;

the brush bristle transplantation concentration: 100,000 number/inch$^2$;

the brush fiber diameter: about 25 to 35 μm;

bristle inclination process of brush forefront: present;

the brush diameter ϕ: 15 to 16 mm; and the amount at which the brush fiber bites into the intermediate transfer belt 8: 1 mm.

The voltage applied to the pre-cleaning brush roller 101 is set so that excellent cleaning performance can be obtained when the non-transferred toner image in which a large amount of toner is adhered to the intermediate transfer belt 8 is input. The reversely-charged toner cleaning brush roller 104 is set to a high voltage so that charges can be injected into the toner on the intermediate transfer belt 8. The brush bristle transplantation concentration, the brush resistance, the fiber diameter, the applied voltage, a kind of fiber, and the brush fiber biting amount can be optimized according to a system and thus are not limited thereto. A kind of usable fiber includes nylon, acryl, and polyester.

The condition of each of the collecting rollers 102, 105, and 108 are as follows:

a collecting roller cored bar material: SUS;

the amount at which the brush fiber bites into the collecting roller; 1.5 mm and an applied voltage of a collecting roller cored bar The Pre-collecting roller: 2000 to 2400 V the reversely-charged toner collecting roller: −2400 to −2800 V the normally-charged toner collecting roller: +1000 to +1400 V.

The collecting roller material, the brush fiber biting amount, and the applied voltage can be optimized according to a system and thus are not limited thereto.

The condition of each of the scraping blades 103, 106, and 109 are as follows:

a blade abutting angle: 20°;

the blade thickness: 0.1 mm; and the amount at which the blade bites into the collecting roller: 1.0 mm.

The blade abutting angle, the blade thickness, and the amount bitten into the collecting roller can be optimized according to a system and thus are not limited thereto.

Next, a cleaning operation of the present belt cleaning apparatus 100 will be explained.

As illustrated in FIG. 4, the residual transfer toner that passed through the secondary transfer unit and the non-transferred toner image are transferred to the position of the pre-cleaning brush roller 101 by rotation of the intermediate transfer belt 8 after passing through the abutting section of the inlet seal 111. A voltage having the polarity (the positive polarity) reverse to the normal charging polarity of the toner is applied to the pre-cleaning brush roller 101. By an electric field formed by the surface potential difference between the intermediate transfer belt 8 and the pre-cleaning brush roller 101, the toner charged to the negative polarity on the intermediate transfer belt 8 is electrostatically absorbed and then moved to the pre-cleaning brush roller 101. The toner having the negative polarity moved to the pre-cleaning brush roller 101 is transferred up to the abutting position on the pre-collecting roller 102 to which a voltage having the positive polarity higher than the pre-cleaning brush roller 101 is applied. By an electric field formed by the potential difference between the surface potential of the pre-cleaning brush roller 101 and the surface potential of the pre-collecting roller 102, the toner moved to the pre-cleaning brush roller 101 is electrostatically absorbed into and then moved to the pre-collecting roller 102. The toner having the negative polarity moved to the pre-collecting roller 102 is scraped and fallen from the collecting roller surface by the pre scarping blade 103. The toner scraped and fallen by the pre scarping blade 103 is discharged to the apparatus outside by the conveying screw 110.

The toner having the negative polarity and the toner having the positive polarity of the non-transferred toner image on the intermediate transfer belt 8, which could not be removed by the pre-cleaning brush roller 101, and the residual transfer toner having the positive polarity are transferred to the position of the reversely-charged toner cleaning brush roller 104. A voltage having the same polarity (the negative polarity) as the normal charging polarity of the toner is applied to the reversely-charged toner cleaning brush roller 104. By an electric field formed by the surface potential difference between the intermediate transfer belt 8 and the reversely-charged toner cleaning brush roller 104, the toner charged to the positive polarity on the intermediate transfer belt 8 is electrostatically absorbed into and then moved to the reversely-charged toner cleaning brush roller 104. At the same time, by charge injection or discharging, the polarity of the toner on the intermediate transfer belt 8 is adjusted to the negative polarity. The toner having the positive polarity moved to the reversely-charged toner cleaning brush roller 104 is transferred up to the abutting position on the reversely-charged toner collecting roller 105 to which a voltage having the negative polarity higher than the reversely-charged toner cleaning brush roller 104 is applied. By an electric field formed by the potential difference between the surface potential of the reversely-charged toner cleaning brush roller 104 and the surface potential of the reversely-charged toner collecting roller 105, the toner moved to the reversely-charged toner cleaning brush roller 104 is electrostatically absorbed and then moved to the reversely-charged toner collecting roller 105. The toner having the positive polarity moved to the reversely-charged toner collecting roller 105 is scraped and fallen from the collecting roller surface by the reversely-charged toner scarping blade 106.

The toner shifted to the negative polarity by the reversely-charged toner cleaning brush roller 104 and the toner having the negative polarity that could not be removed by the pre-cleaning brush roller 101 are transferred to the normally-charged toner cleaning brush roller 107. A polarity of the toner transferred to the normally-charged toner cleaning brush roller 107 is controlled to the negative polarity by the reversely-charged toner cleaning brush roller 104. Further, the toner on the intermediate transfer belt 8 is mostly removed by the pre-cleaning brush roller 101 and the reversely-charged toner cleaning brush roller 104. For this reason, the amount of the toner transferred to the normally-charged toner cleaning brush roller 107 is very small. The toner transferred to the normally-charged toner cleaning brush roller 107 is adjusted to the negative polarity, and the small amount of the toner on the intermediate transfer belt 8 is electrostatically absorbed into the normally-charged toner cleaning brush roller 107 to which a voltage having the polarity (the positive polarity) reverse to the normal charging polarity of the toner, collected by the normally-charged toner collecting roller 108, and scrapped and fallen from the normally-charged toner collecting roller 108 by the normally-charged toner scraping blade 109.

As described above, according to the present belt cleaning apparatus 100, by disposing the pre-cleaning brush roller 101, the toner having the negative polarity that mostly occupies the non-transferred toner image is roughly removed by the pre-cleaning brush roller 101. Therefore, it is possible to reduce the amount of the toner to be input to the reversely-charged toner cleaning brush roller 104 or the normally-charged toner cleaning brush roller 107. For the large amount of toner on the intermediate transfer belt 8, the toner having the positive polarity is not prohibited from being adhered to the reversely-charged toner cleaning brush roller 104, and thus the toner having the positive polarity can be effectively removed from the intermediate transfer belt 8 by the reversely-charged toner cleaning brush roller 104. The toner, on the intermediate transfer belt 8, to be transferred to the normally-charged toner cleaning brush roller 107 at the most downstream of the belt moving direction is one which was not removed by the pre-cleaning brush roller 101 and the reversely-charged toner cleaning brush roller 104, and the amount of the toner is very small. Further, it is the toner adjusted to the negative polarity by the reversely-charged toner cleaning brush roller 104. Therefore, the residual toner can be effectively removed by the normally-charged toner cleaning brush roller 107. Accordingly, even the non-transferred toner image in which the large amount of the toner is adhered to the intermediate transfer belt 8 can be effectively removed from the intermediate transfer belt 8.

The residual transfer toner that has the toner amount smaller than the non-transferred toner image can be also effectively removed by the three cleaning brush rollers 101, 104, and 107.

Further, the present belt cleaning apparatus 100 performs polarity control of adjusting the charging polarity of the toner passing through the reversely-charged toner cleaning brush roller 107 to the negative polarity by injecting charges of the negative polarity into the toner on the intermediate transfer belt 8 by the reversely-charged toner cleaning brush roller 104, but such polarity control may not be performed. Further, in the present belt cleaning apparatus 100, the normally-charged toner cleaning unit 100*c* is disposed at the most downstream side of the belt moving direction, but the reversely-charged toner cleaning unit 100*b* may be disposed at the most downstream side of the belt moving direction. In this case, polarity control of adjusting the charging polarity of the toner passing through the reversely-charged toner cleaning brush roller 107 to the positive polarity by injecting charges of the positive polarity into the toner on the intermediate transfer belt 8 by the normally-charged toner cleaning brush roller 107 may be performed, or such polarity control may not be performed.

Further, the present belt cleaning apparatus 100 removes the toner having the positive polarity on the intermediate transfer belt 8 by the reversely-charged toner cleaning brush roller 104 but may be configured not to remove the toner having the positive polarity on the intermediate transfer belt 8 by replacing the reversely-charged toner cleaning unit 100*b* with a polarity control unit. In this case, the toner on the intermediate transfer belt 8 that passed through the pre-cleaning brush roller 101 is adjusted to the negative polarity by the polarity control unit and then transferred to the normally-charged toner cleaning brush roller 107 at the downstream side of the polarity control unit in the belt moving direction. The toner having the negative polarity is removed by the normally-charged toner cleaning brush roller 107. A means for injecting charges having the negative polarity to the toner on the intermediate transfer belt 8 in the polarity control unit may include a conductive brush, a conductive blade, or a corona charger. The charging polarity of the toner may be adjusted to the positive polarity other than the negative polarity, and a cleaning brush roller to which a voltage of the negative polarity is applied may be disposed at the downstream of the polarity control unit in the belt moving direction to remove the toner, on the intermediate transfer belt, adjusted to the positive polarity. Even in this configuration, since the toner of the non-transferred toner image is roughly removed from the intermediate transfer belt 8 by the pre-cleaning brush roller 101, the amount of the toner to be transferred to the polarity control unit is reduced. Therefore, the toner on the intermediate transfer belt 8 can be effectively adjusted to any one polarity by the polarity control unit. As a result, the toner on the intermediate transfer belt 8 can be electrostatically removed by the cleaning brush roller disposed at the downstream side of the polarity control unit. Accordingly, even the non-transferred toner image that is input to the belt cleaning apparatus 100 with the large amount of toner adhered thereto can be effectively cleaned.

Further, in the present belt cleaning apparatus 100, a voltage is applied to each of the collecting rollers 102, 105, and 108 and each of the cleaning brush rollers 101, 104, and 107 but may be configured to apply a voltage only to the collecting rollers by using a metal roller as each of the collecting roller 102, 105, and 108. In this case, a bias voltage slightly lower than a bias voltage applied to the collecting roller is applied to the cleaning brush roller via a contact portion with the collecting roller by potential drop caused by fiber resistance of the cleaning brush roller. This makes a potential difference between the collecting roller and the cleaning brush roller, and thus the toner can be electrostatically moved from the cleaning brush roller to the collecting roller by the potential gradient in the collecting roller direction.

Next, a modified exemplary embodiment of the present belt cleaning apparatus 100 will be explained.

Figure 6:
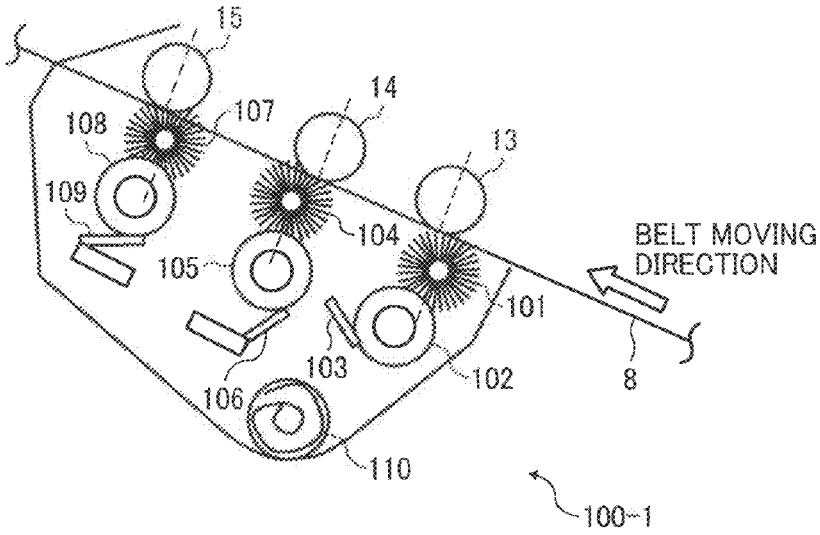
FIG. 6 is a schematic configuration view of a belt cleaning apparatus according to a first modified exemplary embodiment.

First modified exemplary embodiment FIG. 6 is a schematic structure view illustrating a belt cleaning apparatus 100-1 according to a first modified exemplary embodiment.

Figure 7A:
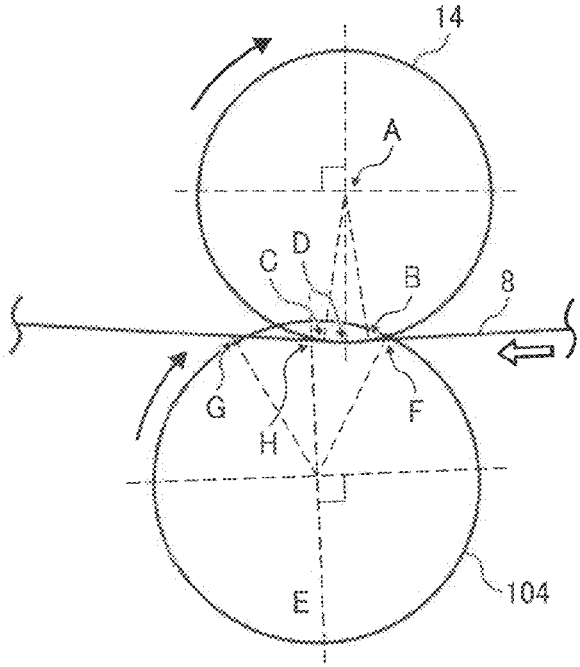
FIGS. 7A and 7B are views for explaining an arrangement relationship between a cleaning facing roller and a cleaning brush roller in the belt cleaning apparatus according to the first modified exemplary embodiment.
Figure 7B:
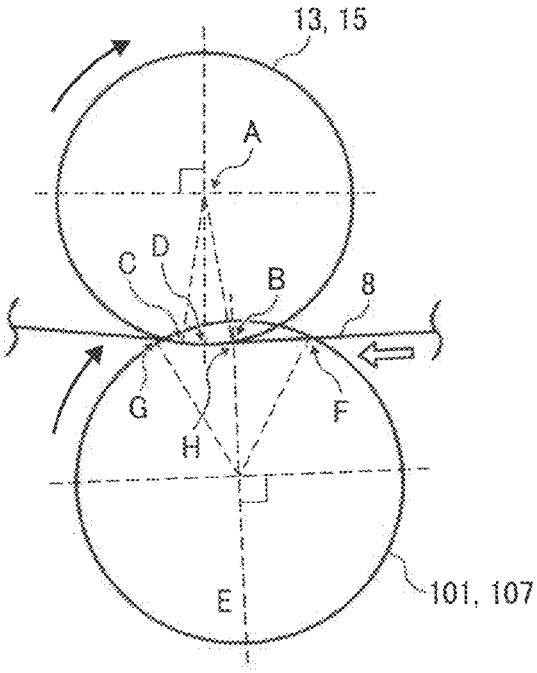

In the belt cleaning apparatus 100-1 according to the first modified exemplary embodiment, an arrangement relationship between the pre-cleaning brush roller 101 and the cleaning facing roller 13 and an arrangement relationship between the normally-charged toner cleaning brush roller 107 and the cleaning facing roller 15 have an arrangement relationship illustrated in FIG. 7B, and an arrangement relationship between the reversely-charged toner cleaning brush roller 104 and the cleaning facing roller 14 has an arrangement relationship illustrated in FIG. 7A. That is, as illustrated in FIG. 7B, an arrangement relationship between the pre-cleaning brush roller 101 and the cleaning facing roller 13 and an arrangement relationship between the normally-charged toner cleaning brush roller 107 and the cleaning facing roller 15 has a relationship in which the cleaning facing roller is disposed at the downstream side of the cleaning brush roller in the belt moving direction (a point D is at a downstream side of a point H in the belt moving direction). Further, as illustrated in FIG. 7A, an arrangement relationship between the reversely-charged toner cleaning brush roller 104 and the cleaning facing roller 14 has a relationship in which the cleaning facing roller is disposed at an upstream side of the cleaning brush roller in the belt moving direction (a point D is at an upstream side of a point H in the belt moving direction).

Figure 8:
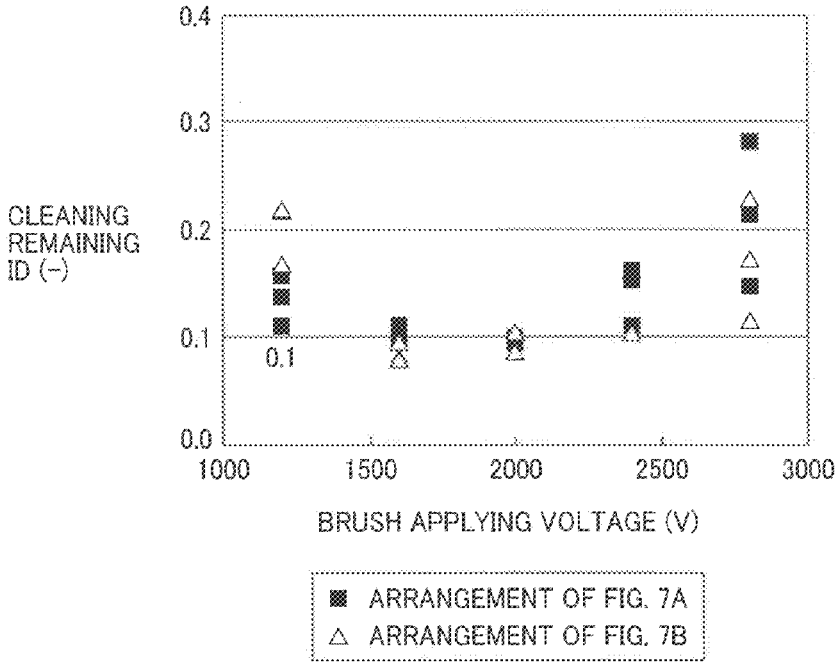
FIG. 8 is a graph illustrating a result of evaluating a difference in the cleaning characteristic according to a position relationship between a cleaning brush roller and a cleaning facing roller.

FIG. 8 is a graph illustrating a result of evaluating a difference of a cleaning characteristic by a position relationship between the cleaning brush roller and the cleaning facing roller. As an evaluation method, a secondary transfer current was set to "0," and ten pieces of three color-superimposed solid images of A3 were passed through. At this time, a toner input to the belt cleaning apparatus was 1.2 $mg/cm^2 \times 10$ (pieces) in adhesion amount. In the belt cleaning apparatus, the reversely-charged toner cleaning brush roller 104 and the normally-charged toner cleaning brush roller 107 were detached, and only the pre-cleaning brush roller 101 was used. In FIG. 8, a cleaning remain ID on a vertical axis is the following index. "cleaning remaining ID" is a value obtained by tape-transferring the toner on the intermediate transfer belt 8 through the Scotch Tape(trademark of 3M Corporation) after cleaning by the pre-cleaning brush roller 101, attaching it onto a white paper and measuring by a spectral colorimeter (X-Rite938), attaching only the tape to the same white paper by the Scotch tape and measuring by the spectral colorimeter, and subtracting a reflected density (i.e., image density (ID)) in which the tape and the white paper are combined by the Scotch tape from the reflected density (ID) in which the toner, the tape, and the white paper are combined. The ID and the toner number are correlated with each other. The more the toner number is, the larger a value of the ID is. Therefore, the cleaning characteristic can be judged using the ID. The smaller the cleaning remaining ID is, the better the cleaning characteristic is.

As can be seen from FIG. 8, when a large amount of toner is input to the pre-cleaning brush roller 101, the best cleaning characteristic is obtained in a range of 1600 V to 2000 V. However, in a range higher than 2000 V, the cleaning remaining ID gets worse. This is because the polarity of the toner is inverted by charge injection into the toner or discharging, and so reverse adhesion in which the toner returns from the pre-cleaning brush roller 101 to the intermediate transfer belt 8 occurs. Further, it can be understood that if a voltage is high, the arrangement in which the cleaning facing roller is misaligned at the downstream side of the belt moving direction with respect to the cleaning brush roller (FIG. 7B) is more excellent in cleaning characteristic. This is because the arrangement of FIG. 7B hardly causes discharging, and polarity inversion of the toner is reduced, thereby preventing reverse adhesion in which the toner returns from the cleaning brush roller to the intermediate transfer belt.

A position and mechanism in which polarity inversion occurs by charge injection to the toner or discharging are indefinite. However, charging easily occurs in an area where the brush contacts or separates from the belt near end points (G and F in FIGS. 7A and 7B) of the brush nip in which the cleaning brush roller contacts the intermediate transfer belt. An electric field is formed between the cleaning brush roller and the grounded cleaning facing roller by the voltage applied to the cleaning brush roller. In the arrangement of FIG. 7A, at a point F at which the distance between the cleaning brush roller and the cleaning facing roller is shortest, an electric field is strong, and discharging easily occurs. Since the cleaning brush roller rotates to move the bristle in a direction (a counter direction) reverse to the intermediate transfer belt moving direction in the brush nip, the toner is easily affected by discharging near the F side, and polarity inversion easily occurs. As a result, the arrangement of FIG. 7A in which the cleaning facing roller is disposed at the upstream side of the belt moving direction with respect to the cleaning brush roller got worse in cleaning remaining ID.

In the arrangement of FIG. 7B, at a point G at which the distance between the cleaning brush roller and the cleaning facing roller is shortest, an electric field is strong, and discharging easily occurs. The cleaning brush roller rotates to move the bristle in a direction (a counter direction) reverse to the intermediate transfer belt moving direction in the brush nip. Even though discharge occurs at the G side, since the toner was already removed by the collecting roller, a small amount of toner is present on the cleaning brush roller at the G side. Therefore, polarity inversion of the toner caused by discharging hardly occurs.

When a large amount of toner is input to the cleaning brush roller, even though a slight high voltage is applied to the cleaning brush roller, discharging hardly occurs due to affection of the toner adhered to the cleaning brush roller or the toner adhered to the intermediate transfer belt. However, when a small amount of toner is input to the cleaning brush roller, since affection of the toner is reduced, discharging easily occurs. In the present belt cleaning apparatus, a voltage applied to the cleaning brush roller is set to be capable to obtain the excellent cleaning characteristic when the non-transferred toner image in which a large amount of toner is adhered to the intermediate transfer belt 8 is input. For this reason, when a small amount of toner is input to the cleaning brush roller, for example, when cleaning the residual transfer toner, a voltage applied to the cleaning brush roller becomes very high, and so discharging easily occurs. At this time, using the arrangement of FIG. 7B (the cleaning facing roller downstream side), even though a voltage applied to the cleaning brush roller is too high on the amount of toner input to the cleaning brush roller, polarity inversion of the toner can be prevented, thereby preventing the cleaning characteristic from getting worse.

In the case of the arrangement of FIG. 7B, even when a small amount of toner is input, the pre-cleaning brush roller 101 and the normally-charged toner cleaning brush roller 107 that function to remove the toner are hardly affected by discharging, and adhesion caused by polarity inversion of the toner hardly occurs. Meanwhile, the reversely-charged toner cleaning brush roller 104 does not only remove the toner having the positive polarity but also performs polarity control of adjusting the polarity of the toner passing through it to the negative polarity. Therefore, using the arrangement of FIG. 7A, discharging can be actively generated, and so polarity control of the toner can be effectively performed.

As described above, in the belt cleaning apparatus 100-1 according to the first modified exemplary embodiment, when removing the residual transfer toner, even if a small amount of toner is input to the belt cleaning apparatus, the excellent cleaning characteristic can be obtained.

Next, the toner suitably used in the present printer will be explained.

The toner suitably used in the present printer preferably has the volume average particle diameter(Dv) of 3 to 6 μm in order to reproduce a small dot equal to or higher than 600 dpi. The toner in which a ratio between the volume average particle diameter and the number average particle diameter (Dv/Dn) is in a range of 1.00 to 1.40 is preferably. The closer the ratio Dv/Dn is, the sharper a particle diameter distribution is. Through the toner having the small particle diameter and the narrow particle diameter distribution, a high quality image in which a charging amount distribution of the toner is uniform and surface fogging is small can be obtained. Further, in the electrostatic photography technique, it is possible to increase the transfer rate.

Figure 9:
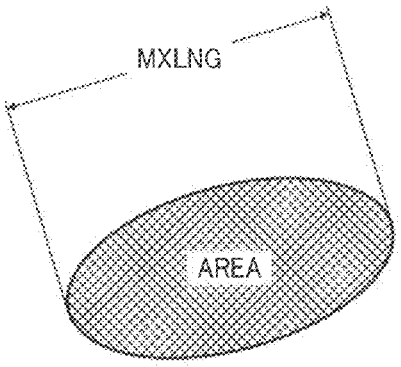
FIG. 9 is a schematic view for explaining a maximum length MXLNG and a plane area AREA of an image obtained by projecting a toner particle on a two-dimensional plane.

A shape factor SF-1 of the toner is preferably in a range of 100 to 180, and a shape coefficient SF-2 is in a range of 100 to 1800. FIG. 9 is a schematic view illustrating the shape of the toner to explain the shape coefficient SF-1. The shape factor SF-1 represents a roundness rate of the toner shape and is expressed as in Formula (1). The shape factor SF-1 is obtained by dividing a square of a maximum length MXLNG of a shape generated by projecting the toner on a two-dimensional plane by a figure area and multiplying by 100π/4.

$$SF\text{-}1=\{(MXLNG)2/\mathrm{AREA}\}\times(100\pi/4 \quad (1)$$

When a value of SF-1 is 100, the toner has a spherical shape, and as the value of SF-1 increases, the shape of the toner gets closer to an indeterminate shape.

Figure 10:
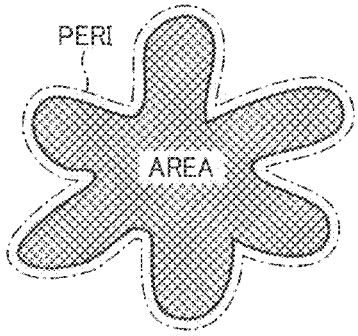
FIG. 10 is a schematic view for explaining a peripheral length PERI and a plane area AREA of an image obtained by projecting a toner particle on a two-dimensional plane.

FIG. 10 is a schematic view illustrating the shape of the toner to explain the shape coefficient SF-2. The shape factor SF-2 represents a concave-convex rate of the toner shape and is expressed as in Formula (2). The shape factor SF-2 is obtained by dividing a square of a peripheral length PERI of a shape generated by projecting the toner on a two-dimensional plane by a figure area and multiplying by 100 m/4.

$$SF\text{-}2=\{(PERI)2/\mathrm{AREA}\}\times(100\pi/4 \quad (2)$$

When a value of SF-2 is 100, a concave-convex portion is not present on the toner surface, and as the value of SF-2 increases, the concave-convex portion of the toner surface becomes more prominent.

The shape factor was measured by taking a photograph of the toner by a scanning electron microscope (SEM) (S-800: made by Hitachi, Ltd.), introducing it to an image analysis apparatus (LUSEX3: manufactured by Nikon corporation), and performing analysis and computation on it. If the shape is close to the spherical shape, a contact state of the toner or between the toner and the photoreceptor becomes a point contact. For this reason, absorption force between the toners gets weak, so that fluidity increases. Further, absorption force between the toner and the photoreceptor gets weak, and the transfer rate increases. If any of SF-1 and SF-2 exceeds 180, it is undesirable because the transfer rate gets worse.

The toner suitably used in the color printer is a toner including at least polyester, a colorant, and a releasing agent. As the polyester, a urea-modified polyester may be used. Also, as the polyester used in the toner, in addition to the urea-modified polyester, a unmodified polyester is preferably contained. The toner is obtained by using a toner material liquid having preferably a polyester prepolymer having a functional group containing a nitrogen atom, unmodified polyester, a colorant, and a releasing agent, other additive as needed, and an organic dispersing solvent. The toner material liquid is dispersed in an aqueous solvent into a cross-linking and/or extension reaction. Examples of the other additives include, for example, electric charge controller, extend additive. A construction material and a manufacturing method of the toner will be explained below.

(Polyester and Polyester Prepolymer)

Polyester is obtained by a polycondensation reaction of a polyhydric alcohol compound and a polycarboxylic compound.

Examples of the polyhydric alcohol compounds (PO) include dihydric alcohols (DIO) and trihydric or higher polyhydric alcohols (TO), and the polyhydric alcohol compounds (PO) is preferably (DIO) by itself or a mixture of (DIO) and a small amount of (TO). Examples of the dihydric alcohol (DIO) include alkylene glycols (ethylene glycol, 1,2-propylene glycol, 1,3-propylene glycol, 1,4-butanediol, 1,6-hexanediol and the like); alkylene ether glycols (diethylene glycol, triethylene glycol, dipropylene glycol, polyethylene glycol, polypropylene glycol, polytetramethylene ether glycol and the like); alicyclic diols (1,4-cyclohexane dimethanol, hydrogenated bisphenol A and the like); bisphenols (bisphenol A, bisphenol F, bisphenol S and the like); alkylene oxide (ethylene oxide, propylene oxide, butylene oxide and the like) adducts of the alicyclic diols mentioned earlier; alkylene oxide (ethylene oxide, propylene oxide, butylene oxide and the like) adducts of the bisphenols mentioned earlier and the like. Among them, as the dihydric alcohol (DIO), alkylene glycols having 2 to 12 carbon atoms and alkylene oxide adducts of bisphenols are preferably used, and especially alkylene oxide adducts of bisphenols and a combination of alkylene oxide adducts of bisphenols and alkylene glycols having 2 to 12 carbon atoms are more preferable. Examples of the trihydric or higher polyhydric alcohol(TO) include trihydric to octahydric alcohol or higher polyhydric aliphatic alcohol (glycerin, trimethylol ethane, trimethylol propane, pentaerythritol, sorbitol and the like); triphenols or higher polyphenols (trisphenol PA, phenol novolac, cresol novolac and the like); alkylene oxide adducts of the triphenols or higher polyphenols mentioned earlier, and the like.

Examples of the polycarboxylic acids (PC) include dicarboxylic acid (DIC) and tricarboxylic or higher polycarboxylic acids (TC), and the polycarboxylic acids (PC) is preferably (DIC) by itself or a mixture of (DIC) and a small amount of (TC). Examples of the dicarboxylic acids (DIC) include alkylene dicarboxylic acids (succinic acid, adipic acid, sebacic acid, etc.), alkenylene dicarboxylic acids (maleic acid, fumaric acid, etc.), and aromatic dicarboxylic acids (phthalic acid, isophthalic acid, terephthalic acid, naphthalene dicarbonic acid, etc.). Among them, the dicarboxylic acid (DIC) is preferably alkenylene dicarboxylic acids having 4 to 20 carbon atoms and aromatic dicarboxylic acids having 8 to 20 carbon atoms. Examples of tricarboxylic or higher polycarboxylic acids (TC) include aromatic polycarboxylic acids having 9 to 20 carbon atoms (trimellitic acid, pyromellitic acid, etc.). Further, acid anhydrides of the compounds mentioned earlier, or lower alkyl esters (methyl ester, ethyl ester, isopropyl ester, etc.) may be also allowed to react with the polyhydric alcohols (PO) to obtain the polycarboxylic acids (PC).

A ratio of the polyhydric alcohols (PO) and the polycarboxylic acids (PC), which is expressed as an equivalent ratio (OH)/(COOH) of a hydroxyl group (OH) and a carboxyl group (COOH), is normally 2/1 to 1/1, preferably 1.5/1 to 1/1, and further preferably 1.3/1 to 1.02/1. In the polycondensation reaction of the polyhydric alcohols (PO) and the polycarboxylic acids (PC), the polyhydric alcohols (PO) and the polycarboxylic acids (PC) are heated to 150° C. to 280° C. in the presence of a commonly known esterification catalyst such as tetrabutoxy titanate, dibutyltin oxide, etc. Pressure is reduced if necessary and water generated during the reaction is distilled off to obtain a polyester that has a hydroxyl group. A hydroxyl group number of greater than or equal to 5 is preferable for the polyester. An acid number of the polyester is normally 1 to 30, and preferably 5 to 20. Causing the polyester to have the acid number increases the negative electrostatic charge of the toner. Further, when fixing the toner on a recording sheet, the acid number enhances affinity of the recording sheet and the toner and also enhances low temperature fixability. However, the acid number exceeding 30 negatively affects the stability of the electrostatic charge, especially negative to environmental variations. Further, a weight average molecular weight of the polyester is 10,000 to 400,000 and preferably 20,000 to 200,000. A weight average molecular weight of less than 10,000 causes anti-offset ability of the toner to deteriorate and is not preferable. Further, the weight average molecular weight exceeding 400,000 causes the low temperature fixability of the toner to deteriorate and is not preferable.

In addition to the unmodified polyester, which is obtained by the polycondensation reaction mentioned earlier, a urea-modified polyester is also preferable and contained. For obtaining the urea-modified polyester, a carboxyl group or a hydroxyl group at the end of the polyester, which is obtained by the polycondensation reaction, is allowed to react with a polyisocyanate compound (PIC) to get a polyester prepolymer (A) that has an isocyanate group. The polyester prepolymer (A) is allowed to react with amines and during the reaction, and a molecular chain is subjected to the crosslinking reaction and/or the elongation reaction to obtain the urea-modified polyester. Examples of the polyisocyanate compounds (PIC) are aliphatic polyisocyanates (tetramethylene diisocyanate, hexamethylene diisocyanate, 2,6-diisocyanatomethyl caproate, etc.), alicyclic polyisocyanates (isophorone diisocyanate, cyclohexyl methane diisocyanate, etc.), aromatic diisocyanates (tolylene diisocyanate, diphenyl methane diisocyanate, etc.), aromatic aliphatic diisocyanates ($\alpha,\alpha,\alpha',\alpha'$-tetramethyl xylylene diisocyanate, etc.), isocyanates, compounds that are obtained by blocking the polyisocyanates mentioned earlier using phenol derivatives, oximes, caprolactam, etc., and combinations of two or more types of the compounds mentioned earlier. A ratio of the polyisocyanate compounds (PIC), which is expressed as an equivalent ratio (NCO)/(OH) of an isocyanate group (NCO) and a hydroxyl group (OH) of the polyester that has a hydroxyl group, is normally 5/1 to 1/1, preferably 4/1 to 1.2/1, and further preferably 2.5/1 to 1.5/1. If the ratio of (NCO)/(OH) exceeds 5, the low temperature fixability of the toner deteriorates. If a molar ratio of (NCO) is less than 1/1, when using the urea-modified polyester, a urea content in the polyester decreases and the anti-offset ability of the toner deteriorates. The content of the polyisocyanate compound (PIC) component in the polyester prepolymer (A) that has an isocyanate group is normally 0.5% to 40% by weight, preferably 1% to 30% by weight, and further preferably 2% to 20% by weight. If the content of the polyisocyanate compound (PIC) component is less than 0.5% by weight, the anti-offset ability of the toner deteriorates and maintaining a balance between heat resistant storability and the low temperature fixability of the toner becomes difficult. Further, if the content of the polyisocyanate compound (PIC) component exceeds 40% by weight, the low temperature fixability of the toner deteriorates. The number of isocyanate groups contained in the polyester prepolymer (A) per molecule is normally greater than or equal to one, preferably 1.5 to 3, and further preferably 1.8 to 2.5. If the number of isocyanate groups per molecule is less than one, a molecular weight of the urea-modified polyester decreases and the anti-offset ability of the toner deteriorates.

Next, examples of the amines (B) which are allowed to react with the polyester prepolymer (A) are diamine compounds (B1), triamines or higher polyamine compounds (B2), amino alcohols (B3), amino mercaptans (B4), amino acids (B5), and compounds (B6) in which amino groups of B1 to B5 are blocked.

Examples of the diamine compounds (B1) include aromatic diamines (phenylene diamine, diethyl toluene diamine, 4,4'-diamine diphenyl methane, etc.), alicyclic diamines (4,4'-diamino-3,3'-dimethyl dicyclohexyl methane, diamine cyclohexane, isophorone diamine, etc.), and aliphatic diamines (ethylene diamine, tetramethylene diamine, hexamethylene diamine, etc.). Examples of the triamines or higher polyamine compounds (B2) include diethylene triamine and triethylene tetramine. Examples of the amino alcohols (B3) include ethanolamine and hydroxyethyl aniline. Examples of the amino mercaptans (B4) are aminoethyl mercaptan and aminopropyl mercaptan. Examples of the amino acids (B5) include aminopropionic acid and aminocaproic acid. Examples of the compounds (B6) wherein the amino groups of B1 to B5 are blocked include ketimine compounds and oxazolidine compounds, which are obtained from the amines B1 to B5 mentioned earlier and ketones (acetone, methyl ethyl ketone, methyl isobutyl ketone, etc.). Among the amines (B), the diamine compounds of B1 and mixtures of B1 and a small amount of B2 are preferable.

A ratio of the amines (B), which is expressed as an equivalent ratio (NCO)/(NHx) of an isocyanate group (NCO) from the polyester prepolymer (A) that has the isocyanate group and an amino group (NHx) from the amines (B), is normally 1/2 to 2/1, preferably 1.5/1 to 1/1.5, and further preferably 1.2/1 to 1/1.2. If the ratio (NCO)/(NHx) becomes greater than 2 or less than ½, the molecular weight of the urea-modified polyester is reduced and the anti-offset ability of the toner deteriorates.

The urea-modified polyester may also have urethane bonds along with urea bonds. A molar ratio of a content of the urea bonds and a content of the urethane bonds is normally 100/0 to 10/90, preferably 80/20 to 20/80, and further preferably 60/40 to 30/70. If the molar ratio of the urea bonds is less than 10%, the anti-offset ability of the toner deteriorates.

The urea-modified polyester is manufactured using a one shot method, etc. The polyhydric alcohols (PO) and the polycarboxylic acids (PC) are heated to 150° C. to 280° C. in the presence of a commonly known esterification catalyst such as tetrabutoxy titanate, dibutyltin oxide, etc. Pressure is reduced if necessary and water generated during the reaction is distilled to obtain the polyester that has a hydroxyl group. Next, the polyester is allowed to react with polyisocyanate (PIC) at 40° C. to 140° C. to get the polyester prepolymer (A) that has an isocyanate group. Next, the polyester prepolymer (A) is allowed to react with the amines (B) at 0° C. to 140° C. to get the urea-modified polyester.

When allowing the polyester to react with (PIC) and when allowing (A) to react with (B), a solvent may also be used if necessary. Examples of the solvents that may be used include aromatic solvents (toluene, xylene, etc.), ketones (acetone, methyl isobutyl ketone, etc.), esters (ethyl acetate, etc.), amides (dimethyl formamide, dimethyl acetoamide, etc.), and ethers (tetrahydrofuran, etc.) that are inactive with respect to the isocyanates (PIC).

Further, during the crosslinking reaction and/or the elongation reaction between the polyester prepolymer (A) and the amines (B), a reaction terminator may also be used if necessary and the molecular weight of the obtained urea-modified polyester may be regulated. Examples of the reaction terminator are monoamines (diethylamine, dibutylamine, butylamine, laurylamine, etc.) and compounds (ketimine compounds) in which the monoamines are blocked.

The weight average molecular weight of the urea-modified polyester is normally greater than or equal to 10,000, preferably 20,000 to 100,000,000, and further preferably 30,000 to 1,000,000. If the weight average molecular weight of the urea-modified polyester is less than 10,000, the anti-offset ability of the toner deteriorates. When using the unmodified polyester, a number average molecular weight of the urea-modified polyester is not especially limited, and any number average molecular weight that is easily converted into the weight average molecular weight may be used. When using the urea-modified polyester by itself, the number average molecular weight of the urea-modified polyester is normally 2,000 to 15,000, preferably 2,000 to 10,000, and further preferably 2,000 to 8,000. The number average molecular weight of the urea-modified polyester exceeding 20,000 results in deterioration of the low temperature fixability and the gloss of the toner when the toner is used in a full color image-forming apparatus.

Using a combination of the unmodified polyester and the urea-modified polyester enables to enhance the low temperature fixability of the toner and the gloss when the toner is used in a full color image-forming apparatus. Thus, using a combination of the unmodified polyester and the urea-modified polyester is preferable than using the urea-modified polyester by itself. Further, the unmodified polyester may also encompass a polyester that is modified using other chemical bonds than the urea bonds.

At least a portion of the unmodified polyester and the urea-modified polyester being mutually compatible is preferable for the low temperature fixability and the anti-offset ability. Thus, a similar composition of the unmodified polyester and the urea-modified polyester is preferable.

A weight ratio of the unmodified polyester and the urea-modified polyester is normally 20/80 to 95/5, preferably 70/30 to 95/5, further preferably 75/25 to 95/5, and especially preferably 80/20 to 93/7. If the weight ratio of the urea-modified polyester is less than 5%, the anti-offset ability of the toner deteriorates and maintaining a balance between heat resistant storability and the low temperature fixability of the toner becomes difficult.

A glass transition point ($T_g$) of a binder resin that comprises the unmodified polyester and the urea-modified polyester is normally 45° C. to 65° C., and preferably 45° C. to 60° C. If the glass transition point is less than 45° C., a heat resistance of the toner deteriorates. If the glass transition point exceeds 65° C., the low temperature fixability of the toner becomes insufficient.

Because the urea-modified polyester is likely to remain on the surface of the obtained parent toner particles, regardless of the low glass transition point, heat resistant storability of the toner is likely favorable compared to a commonly known polyester-based toner.

(Colorant)

All commonly known dyes and pigments may be used as a colorant. Examples of the colorant that may be used include carbon black, nigrosine dye, iron black, naphthol yellow S, hansa yellow (10G, 5G, G), cadmium yellow, yellow iron oxide, yellow ocher, chrome yellow, titanium yellow, polyazo yellow, oil yellow, hansa yellow (GR1, RN, R), pigment yellow L, benzidine yellow (G, GR), permanent yellow (NCG), vulcan fast yellow (5G, R), tartrazine lake, quinoline yellow lake, anthrazane yellow BGL, isoindolinone yellow, colcothar, minium, red lead, cadmium red, cadmium mercury red, antimony vermilion, permanent red 4R, para red, fire red, parachloro-ortho-nitroaniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmine 6B, pigment scarlet 3B, Bordeaux 5B, toluidine maroon, permanent bordeaux F2K, helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS, BC), indigo, ultramarine blue, Prussian blue, anthraquinone blue, fast violet B, methyl violate lake, cobalt purple, Manganese purple, dioxane violate, anthraquinone violet, chrome green, zinc green, chrome oxide, pyridian, emerald green, pigment green B, naphthol green B, green gold, acid green lake, malachite green lake, phthalocyanine green, anthraquinone green, titanium oxide, zinc white, lithopone and mixtures of the colors mentioned earlier. A content of the colorant is normally 1% to 15% by weight, and preferably 3% to 10% by weight with respect to the toner.

The colorant may also be used as a master batch that is combined with the resin. Styrenes such as polystyrene, poly-p-chlorostyrene and polyvinyl toluene, and substituted polymers of the styrenes mentioned earlier, copolymers of the styrenes mentioned earlier with vinyl compounds, polymethyl methacrylate, polybutyl methacrylate, polyvinyl chloride, polyvinyl acetate, polyethylene, polypropylene, polyester, epoxy resin, epoxypolyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, paraffin wax, etc. are examples of binder resins that are used in the manufacture of the master batch or that are mixed with the master batch. The binder resins mentioned earlier may be used alone or as a mixture.

(Mold Releasing Agent)

When dispersed with the binder resin, wax which has a low melting point of 50° C. to 120° C. functions effectively as the mold releasing agent between a fixing roller and a toner surface. Due to this, wax is effective against heat offset and removes a necessity to coat the fixing roller with a mold releasing agent such as oil. Examples of materials, which are used as a wax component, include described below. Examples of wax materials include plant wax such as carnauba wax, cotton wax, wood wax, rice wax, etc., animal wax such as beeswax, lanolin, etc., mineral wax such as ozokerite, cercine, etc., and petroleum wax such as paraffin, microcrystalline, and petrolatum. Further, in addition to the natural wax mentioned earlier, synthetic hydrocarbon wax such as Fischer-Tropsch wax and polyethylene wax, and synthetic wax synthesized from chemical ingredients such as ester, ketone and ether may also be used. Further, fatty amides such as 1,2-hydroxystearic acid amide, stearic acid amide, phthalic anhydride imide and chlorinated hydrocarbon; and crystalline polymer molecules that has a long alkyl group in a side chain, i.e., low-molecular crystalline polymer resins such as homopolymers or copolymers of polyacrylate such as poly-n-stearyl methacrylate and poly-n-lauryl methacrylate (for example, copolymers of n-stearyl acrylate-ethyl methacrylate, etc.) may also be used.

(Electric Charge Controller)

Commonly known electric charge controllers may be used. Examples of the electric charge controllers are nigrosine dyes, triphenyl methane dyes, chromium-containing metal complex dyes, chelate molybdate pigment, rhodamine dyes, alkoxy amine, quaternary ammonium salt (including fluorine-modified quaternary ammonium salt), alkyl amide, phosphorus in element or compound form, tungsten in element or compound form, fluorine-based activator, salicylic acid metal salt and metal salt of salicylic acid derivative. Specific examples of the electric charge controllers include bontron 03 that is a nigrosine-based dye, bontron P-51 that is a quaternary ammonium salt, bontron S-34 that is a metal-containing azo dye, E-82 that is an oxynaphthoic acid metal complex, E-84 that is a salicylic acid metal complex, E-89 that is a phenol condensate (the chemicals mentioned earlier are manufactured by Orient Chemical Industries), TP-302 that is a quaternary ammonium salt molybdenum complex, TP-415 (the chemicals mentioned earlier are manufactured by Hodogaya Chemicals Company), copy charge PSY VP2038 that is a quaternary ammonium salt, copy blue PR that is a triphenyl methane derivative, copy charge NEG VP2036 that is a quaternary ammonium salt, copy charge NX VP434 (the chemicals mentioned earlier are manufactured by Hoechst Company), LR1-901, LR-147 that is a boron complex (manufactured by Japan Carlit Company), copper phthalocyanine, perylene, quinacridone, azo type pigment, and other polymeric compounds that have functional groups such as a sulfonic acid group, a carboxyl group, a quaternary ammonium salt, etc. Among the materials mentioned earlier, the materials that especially control the toner to the negative polarity are preferably used.

A usage amount of the electric charge controller is determined according to a toner manufacturing method that includes a type of the binder resin, presence or absence of an additive that is used if necessary, a dispersion method, etc. Thus, the usage amount of the electric charge controller is not uniquely limited. However, the usage amount in a range of 0.1 to 10 parts by weight of the electric charge controller with respect to 100 parts by weight of the binder resin is preferably used. A range of 0.2 to 5 parts by weight of the electric charge controller is preferable. If the usage amount of the electric charge controller exceeds 10 parts by weight, the excess electrostatic charge of the toner reduces the effect of the electric charge controller and increases the electrostatic attraction between the toner and the developing roller. Due to this, fluidity of the developer and image density are reduced.

The electric charge controller and the mold releasing agent may also be melted and mixed with the master batch and the binder resin. Needless to say, the electric charge controller and the mold releasing agent may also be added when the master batch and the binder resin are dissolved and dispersed in an organic solvent.

(External Additive)

Inorganic particles are preferably used as the external additive agent for supplementing fluidity, developability, and electrostatic charge of the toner particles. The primary particle diameter of the inorganic particles is preferably $5\times10^{-3}$ to 2 μm, and further preferably $5\times10^{-3}$ to 0.5 μm. Further, the specific surface area of each inorganic particle is preferably in the range of 20 to 500 $m^2/g$, according to Brunauer Emmet Teller (BET) method. The usage ratio of the inorganic particles is preferably 0.01% to 5% by weight, and especially preferably 0.01% to 2.0% by weight of the toner. Specific examples of the inorganic particles include silica, alumina, titanium oxide, barium titanate, magnesium titanate, calcium titanate, strontium titanate, zinc oxide, tin oxide, silica sand, clay, mica, silica apatite, diatomite, chromium oxide, cerium oxide, colcothar, antimony trioxide, magnesium oxide, zirconium oxide, barium sulfate, barium carbonate, calcium carbonate, silicon carbide, silicon nitride, etc. Among them, a combination of hydrophobic silica particles and hydrophobic titanium oxide particles is preferably used as a fluidity enhancer. Especially, if hydrophobic silica particles and hydrophobic titanium oxide particles having an average particle diameter of less than or equal to $5\times10^{-4}$ μm are mixed by stirring, electrostatic power and van der Waals power of the toner are significantly enhanced. Due to this, the fluidity enhancer is not detached from the toner even if the fluidity enhancer is mixed by stirring inside a developing device for getting a desired electrostatic charge level. Thus, a better image quality may be obtained by preventing occurrence of dots and the residual toner after the transfer may be reduced. Although the titanium oxide particles are excellent in environmental stability and image density stability, it tends to deteriorate in the charge rising property of the toner. Thus, if an additive amount of the titanium oxide particles becomes more than an additive amount of the silica particles, influence of the side effect mentioned earlier is likely to increase. However, if the additive amounts of the hydrophobic silica particles and the hydrophobic titanium oxide particles are in a range of 0.3% to 1.5% by weight, the charge rising property of the toner is not significantly affected and a desired charge rising property may be obtained. In other words, a stable image quality may be obtained even if the image is repeatedly copied.

Next, a method of manufacturing the toner is explained. Although the manufacturing method explained below is preferable, the present invention is not limited thereto.

(Manufacture Method for Toner)

(1) For example, the coloring agent, the unmodified polyester, the polyester prepolymer that has an isocyanate group, and the mold releasing agent are dispersed in the organic solvent to form a toner material solution.

A volatile organic solvent having a boiling point of less than 100° C. is preferable for easy removal of the organic solvent after formation of the parent toner particles. To be specific, toluene, xylene, benzene, tetrachlorocarbon, chloromethylene, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. may be used alone or as a combination of two or more chemicals mentioned earlier. Especially, aromatic solvents such as toluene and xylene; and halogenated hydrocarbons such as chloromethylene, 1,2-dichloroethane, chloroform and tetrachlorocarbon are preferable. A usage amount of the organic solvent is normally 0 to 300 parts by weight, preferably 0 to 100 parts by weight, and further preferably 25 to 70 parts by weight with respect to 100 parts by weight of the polyester prepolymer.

(2) The toner material liquid is emulsified in an aqueous solvent in the presence of a surfactant and resin particles.

The aqueous solvent may be water alone or organic solvents may be used in combination such as alcohols (methanol, isopropyl alcohol, ethylene glycol, etc.), dimethyl formamide, tetrahydrofuran, cellosolves (methyl cellosolve, etc.), and lower ketones (acetone, methyl ethyl ketone, etc.).

A usage amount of the aqueous solvent is normally 50 to 2,000 parts by weight, and preferably 100 to 1,000 parts by weight of the aqueous solvent with respect to 100 parts by weight of the toner material liquid. If the usage amount of the aqueous solvent becomes less than 50 parts by weight, the dispersed state of the toner material liquid deteriorates and toner particles of a predetermined particle diameter cannot be obtained. If the usage amount of the aqueous solvent exceeds 2,000 parts by weight, toner manufacturing is not economical.

Further, a dispersing agent such as a surfactant or resin particles is suitably added for enhancing dispersion in the aqueous solvent.

Examples of the surfactant include anionic surfactants such as alkylbenzene sulfonate, α-olefin sulfonate and ester phosphate; cationic surfactants of amine salt type, e.g., alkylamine salts, amino alcohol fatty acid derivatives, polyamine fatty acid derivatives and imidazoline, and quaternary ammonium salt type, e.g., alkyl trimethyl ammonium salt, dialkyldimethyl ammonium salt, alkyldimethylbenzyl ammonium salt, pyridinium salt, alkyl isoquinolium salt and chlorobenzetonium; nonionic surfactants such as fatty acid amide derivatives and polyhydric alcohol derivatives; and zwitterionic surfactants such as alanine, dodecyldi(aminoethyl) glycine, di(octylaminoethyl) glycine and N-alkyl-N,N-dimethyl ammonium betaine.

Using the surfactant that has a fluoroalkyl group enables to enhance the effect of the surfactant with an extremely small amount of the surfactant. Examples of preferably used anionic surfactants that have a fluoroalkyl group include fluoroalkyl carboxylic acids of carbon number 2 to 10 and metal salts thereof, perfluorooctane sulfonyl disodium glutamate, 3-[ω-fluoroalkyl(C6 to C11)oxy]-1-alkyl(C3 to C4)sodium sulfonate, 3-[ω-fluoroalkanoyl(C6 to C8)-N-ethylamino]-1-propane sodium sulfonate, fluoroalkyl (C11 to C20) carboxylic acid and metal salts thereof, perfluoroalkyl carboxylic acid (C7 to C13) and metal salts thereof, perfluoroalkyl (C4 to C12) sulfonic acid and metal salts thereof, perfluorooctane sulfonic acid diethanol amide, N-propyl-N-(2-hydroxyethyl) perfluorooctane sulfonamide, perfluoroalkyl (C6 to C10) sulfonamide propyltrimethyl ammonium salt, perfluoroalkyl (C6 to C10)-N-ethylsulfonyl glycine salt, monoperfluoroalkyl (C6 to C16) ethyl phosphoric acid ester, etc.

Examples of product names include saflon S-111, S-112, S-113 (manufactured by Asahi Glass Company); flolard FC-93, FC-95, FC-98, FC-129 (manufactured by Sumitomo 3M Company); unidine DS-101, DS-102 (manufactured by Daikin Industries Company); megafac F-110, F-120, F-113, F-191, F-812, F-833 (manufactured by Dai Nihon Ink Company); ektop EF-102, 103, 104, 105, 112, 123A, 123B, 306A, 501, 201, 204 (manufactured by Tohkem Products Company); futargent F-100, F-150 (manufactured by Neos Company), etc.

Examples of the cationic surfactant include aliphatic primary, secondary or tertiary amino acids that have a fluoroalkyl group, aliphatic quaternary ammonium salts such as perfluoroalkyl (C6 to C10) sulfonamide propyl trimethyl ammonium salt, benzalkonium salt, benzetonium chloride, pyridinium salt, and imidazolium salt. Examples of product names are saflon S-121 (manufactured by Asahi Glass Company), flolard FC-135 (manufactured by Sumitomo 3M Company), unidine DS-202 (manufactured by Daikin Industries Company), megafac F-150, F-824 (manufactured by Dai Nihon Ink Company), ektop EF-132 (manufactured by Tohkem Products Company), and futargent F-300 (manufactured by Neos Company), etc.

The resin particles are added for stabilizing the parent toner particles that are formed in the aqueous solvent. To stabilize the parent toner particles, the resin particles are preferably added such that a surface coverage of the resin particles on the surface of the parent toner particles is in a range of 10% to 90%. Examples of the resin particles include methyl polymethacrylate particles of 1 μm and 3 μm, polystyrene particles of 0.5 μm and 2 μm, poly(styrene-acrylonitrile) particles of 1 μm, etc. Examples of product names include PB-200H (manufactured by Kao Company), SGP (manufactured by Soken Company), technopolymer-SB (manufactured by Sekisui Plastics Company), SGP-3G (manufactured by Soken Company), Micropearl (manufactured by Sekisui Fine Chemicals Company), etc. Further, dispersing agents of inorganic compounds such as tricalcium phosphate, calcium carbonate, titanium oxide, colloidal silica, and hydroxyapatite may also be used.

By using a polymeric protecting colloid, dispersion droplets of the resin particles mentioned earlier may also be stabilized as a dispersing agent that may be used in combination with the inorganic compound dispersing agent. Examples of the polymeric protecting colloids that may be used include acids such as acrylic acid, methacrylic acid, α-cyanoacrylic acid, α-cyanomethacrylic acid, itaconic acid, crotonic acid, fumaric acid, maleic acid and maleic anhydride; methacrylic monomers that have a hydroxyl group, for example, acrylic acid-β-hydroxyethyl, methacrylic acid-β-hydroxyethyl, acrylic acid-β-hydroxypropyl, methacrylic acid-β-hydroxypropyl, acrylic acid-γ-hydroxypropyl, methacrylic acid-γ-hydroxypropyl, acrylic acid-3-chloro-2-hydroxypropyl, methacrylic acid-3-chloro-2-hydroxypropyl, diethylene glycol monoacrylic acid ester, diethylene glycol monomethacrylic acid ester, glycerin monoacrylic acid ester, glycerin monomethacrylic acid ester, N-methylol acrylic amide, and N-methylol methacrylic amide; vinyl alcohol or ethers with vinyl alcohol, for example, vinyl methyl ether, and vinyl ethyl ether, vinyl propyl ether; esters of a vinyl alcohol and a compound having a carboxyl group, for example, vinyl acetate, vinyl propionate, and vinyl butyrate; acrylic amide, methacrylic amide, diacetone acrylic amide or methylol compounds thereof; acid chlorides such as acryloyl chloride and methacroyl chloride, nitrogen-containing compounds such as vinyl pyridine, vinyl pyrrolidone, vinyl imidazole and ethylene imine; or heterocyclic homopolymers or copolymers thereof; polyoxyethylenes such as polyoxyethylene, polyoxypropylene, polyoxyethylene alkylamine, polyoxypropylene alkyl amine, polyoxyethylene alkyl amide, polyoxypropylene alkyl amide, polyoxyethylene nonylphenyl ether, polyoxyethylene laurylphenyl ether, polyoxyethylene stearylphenyl ester and polyoxyethylene nonylphenyl ester; and celluloses such as methyl cellulose, hydroxyethyl cellulose, and hydroxypropyl cellulose.

The dispersion method is not particularly limited, and commonly known methods such as a low-speed shearing method, a high-speed shearing method, a friction method, a high-pressure jet method, and an ultrasonic method may be applied. Among them, the high speed shearing method is preferable for ensuring a particle diameter of 2 μm to 20 μm of the dispersion body. When the dispersion device of a high-speed shearing method, the revolution number is not particularly limited, but is normally 1,000 to 30,000 revolutions per minute (rpm), and preferably 5,000 to 20,000 rpm. The dispersion time is not particularly limited, but is normally 0.1 to 5 minutes when a batch method is used. The dispersion temperature is normally 0° C. to 150° C. (under pressure), and preferably 40° C. to 98° C.

(3) Along with preparation of an emulsified liquid, amines (B) are simultaneously added and the emulsified liquid is allowed to react with a polyester prepolymer (A) that has an isocyanate group.

During this reaction, the molecular chain is subjected to the crosslinking reaction and/or the elongation reaction. The reaction time is selected based on a reactivity of an isocyanate group structure contained in the polyester prepolymer (A) with the amines (B), but is normally 10 minutes to 40 hours, and preferably 2 hours to 24 hours. The reaction temperature is normally 0° C. to 150° C. and preferably 40° C. to 98° C. A commonly known catalyst may be used if necessary. To be specific, a catalyst such as dibutyltin laurate or dioctyltin laurate may be used.

(4) After completion of the reaction, the organic solvent is removed from the emulsification-dispersion body (reaction product) and the reaction product is cleaned and dried to get the parent toner particles.

For removing the organic solvent, the temperature is gradually increased while stirring a laminar flow of the entire reaction product. After strongly stirring the reaction product at a fixed temperature range, the organic solvent is removed to prepare spindle-shaped parent toner particles. Further, if a chemical such as a calcium phosphate, which is soluble in acid and alkali, is used as a dispersion stabilizer, the calcium phosphate is dissolved using an acid such as hydrochloric acid and the resulting solution is washed with water to remove the calcium phosphate from the toner particles. Further, the calcium phosphate may also be removed using a procedure such as enzymatic breakdown.

(5) An electric charge controller is added to the parent toner particles that are obtained using the method mentioned earlier, and then inorganic particles such as silica particles and titanium oxide particles are externally added to get a toner. Addition of the electric charge controller and external addition of the inorganic particles are carried out by a commonly known method that uses a mixer.

Due to this, a toner having a small particle diameter and a sharp distribution of the particle diameter may be easily obtained. Further, due to strong stirring during the process to remove the organic solvent, a shape of the toner particles may be controlled to a shape between a spherical shape and a rugby ball shape. Further, a surface morphology of the toner particles may also be controlled to between a smooth shape and a corrugated shape.

Figure 11A:
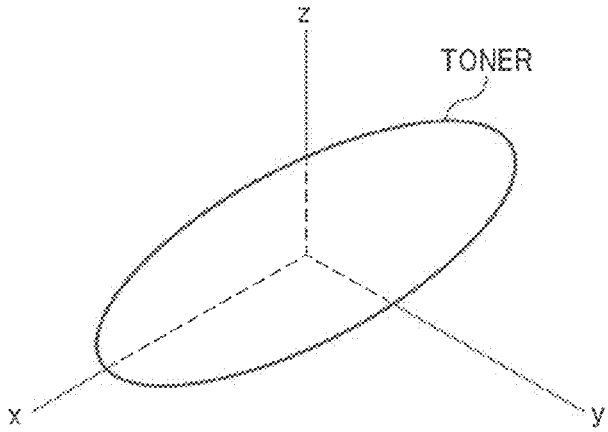
FIGS. 11A, 11B, and 11C are views schematically illustrating a shape of a toner, respectively.
Figure 11B:
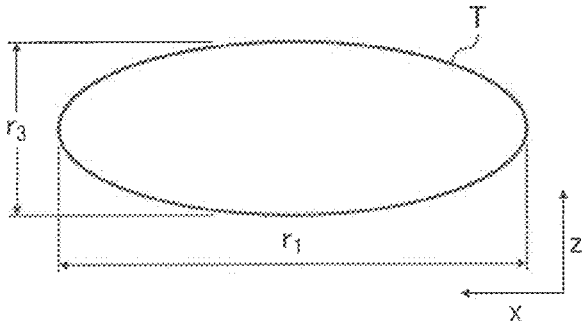
Figure 11C:
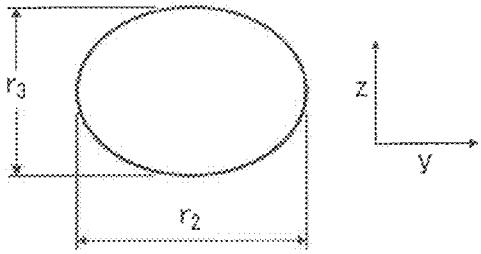

The shape of the toner is nearly spherical and can be expressed by the following shape specification. FIGS. 11A, 11B, and 11C are schematic diagrams illustrating the shape of the toner. In FIGS. 11A, 11B, and 11C, when the toner of the nearly spherical shape is specified by a long axis r1, a short axis r2, and a thickness r3 (here, r1≧r2≧r3), a ratio between the long axis and the short axis (r2/r1) is preferably in a range of 0.1 to 0.5, and a ratio between the thickness and the short axis (r3/r2) is preferably in a range of 0.7 to 1.0. If the ratio between the long axis and the short axis (r2/r1) is less than 0.5, since the spherical shape is not formed, the dot producing ability and the transfer efficiency get worse, and a high quality image cannot be obtained. If the ratio between the thickness and the short axis (r3/r2) is less than 0.7, since the nearly flat shape is formed, it is difficult to obtain the high transfer rate as in the spherical shape. Particularly, if the ratio between the thickness and the short axis (r3/r2) is 1.0, a rotating body having the long axis as the rotating axis is formed, and thus fluidity can be improved.

Further, r1, r2, and r3 were measured by observing a photograph taken by scanning electron microscope (SEM) at various angles.

Figure 12:
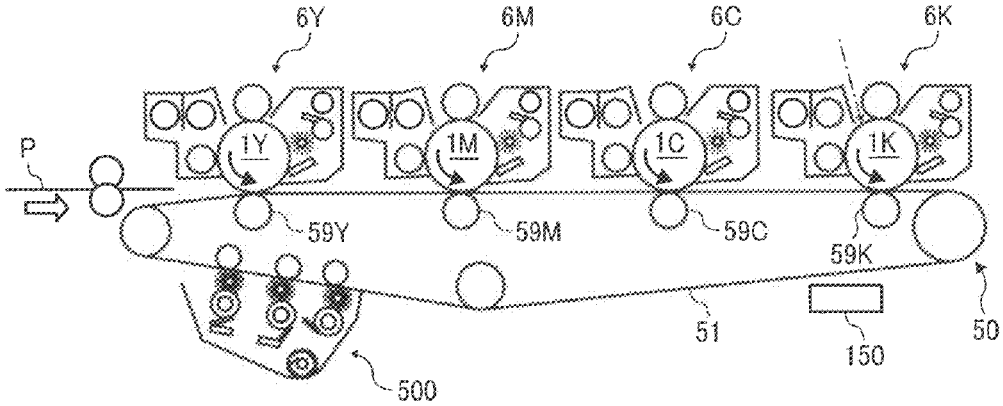
FIG. 12 is a schematic structure view illustrating a main part of a printer of a tandem direct transfer type.

The cleaning apparatus of the present invention is not limited to the belt cleaning apparatus 100 that cleans the surface of the intermediate transfer belt and can be applied to a conveying belt cleaning apparatus 500 of a paper conveying belt 51 of transfer unit 50 as illustrated in FIG. 12. As illustrated in FIG. 12, as a cleaning target used in an image forming apparatus of a tandem direct transfer type, the paper conveying belt 51 contacts the photoreceptors 1Y, 1M, 1C, and 1K of process units 6Y, 6M, 6C, and 6K by primary transfer rollers 59Y, 59M, 59C, and 59K. Then, primary transfer nips for Y, M, C, and K are formed between the photoreceptors and the paper conveying belt 51. The paper conveying belt 51 sequentially conveys the recording paper P to the primary transfer nips for Y, M, C, and K through a process of conveying the recording paper P from the left to the right in the drawing with its endless movement while retaining the recording paper P on its surface. As a result, the Y, M, C, and K toner images are primary-transferred onto the recording paper P in a superimposed manner. The contamination of the toner adhered to the paper conveying belt 51 that passed through the primary nip for K is removed by the conveying belt cleaning apparatus 500. The optical sensor unit 150 is disposed to face the surface of the paper conveying belt 51 with a predetermined gap therebetween. Even in the printer illustrated in FIG. 12, image density control or position misalignment correction control is performed at predetermined timing. A predetermined toner pattern (the gradation pattern and the chevron patch) is formed on the paper conveying belt 51. The toner pattern is detected by the optical sensor unit 150, and a predetermined correction process is performed based on the detection result. The toner pattern that is the non-transferred toner image detected by the optical sensor unit 150 is removed by the conveying belt cleaning apparatus 500. As described above, the paper conveying belt 51 has a function as an image carrier for carrying the toner image.

By applying the cleaning apparatus of the present invention to the conveying belt cleaning apparatus 500, the toner pattern formed on the paper conveying belt 51 can be effectively removed, thereby preventing a back surface of the recording paper from being contaminated.

Figure 13:
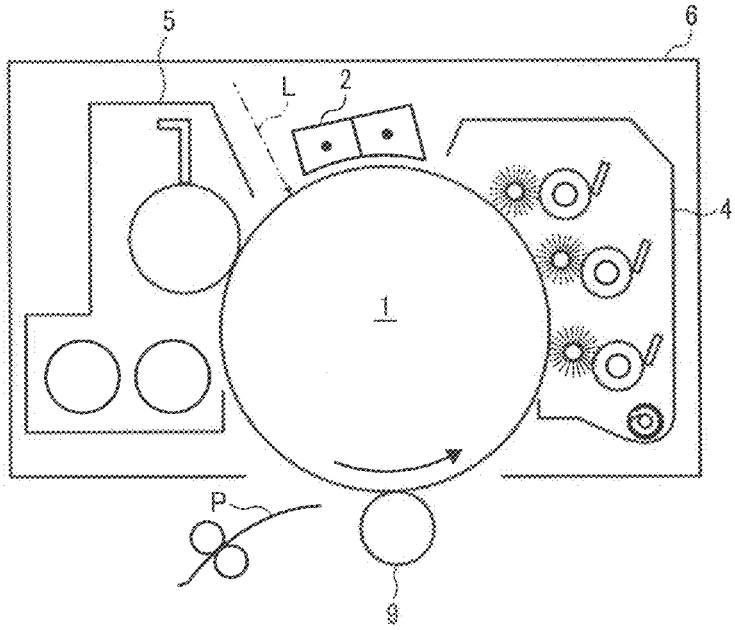
FIG. 13 is a schematic structure view illustrating a main part of a monochrome printer.

Further, the cleaning apparatus of the present invention can be applied to a drum cleaning apparatus 4 in a process unit 6 as illustrated in FIG. 13. The non-transferred toner image such as the toner consumption pattern when the refresh mode for refreshing the inside of the developing apparatus 5 or the toner image on the photoreceptor 1 when the paper jam occurs is input to the drum cleaning apparatus 4. By applying the cleaning apparatus of the present invention to the drum cleaning apparatus 4, the non-transferred toner image input to the drum cleaning apparatus 4 can be effective removed.

As described above, the belt cleaning apparatus 100 as the cleaning apparatus according to the exemplary embodiments includes the normally-charged toner cleaning brush roller 107 as the normally-charged toner cleaning member that receives a voltage having the polarity reverse to the normal charging polarity of the toner and electrostatically removes the toner having the normal charging polarity on the intermediate transfer belt as the cleaning target and the reversely-charged toner cleaning brush roller 104 as the reversely-charged toner cleaning member that receives a voltage having the same polarity as the normal charging polarity of the toner and electrostatically removes the toner having the polarity reverse to the normal charging polarity on the intermediate transfer belt 8. The belt cleaning apparatus 100 further includes the pre-cleaning brush roller 101 as the pre-cleaning member that is disposed the upstream side of the normally-charged toner cleaning brush roller 107 and the reversely-charged toner cleaning brush roller 104 in the surface moving direction of the intermediate transfer belt 8, receives a voltage having the polarity reverse to the normal charging polarity of the toner, and electrostatically removes the toner having the normal charging polarity.

Through this configuration, when the non-transferred toner image having a large amount of toner charged to the normal charging polarity is input to the belt cleaning apparatus 100, the toner, charged to the normal charging polarity, of the non-transferred toner image can be roughly removed by the pre-cleaning brush roller 101. Therefore, the amount of toner to be input to the normally-charged toner cleaning brush roller 107 or the reversely-charged toner cleaning brush roller 104 disposed at the downstream side of the pre-cleaning brush roller 101 in the belt moving direction is reduced. As a result, the toner charged to the normal charging polarity that cannot be removed by the pre-cleaning brush roller 101 can be effectively removed by the normally-charged toner cleaning brush roller 107. Further, the toner charged to the polarity reverse to the normal charging polarity can be effectively removed by the reversely-charged toner cleaning brush roller 104. Accordingly, even though the non-transferred toner image is input to the belt cleaning apparatus, the non-transferred toner image can be effectively removed from the intermediate transfer belt.

Further, the cleaning apparatus, which includes the polarity control unit that controls the normal charging polarity of the toner on the intermediate transfer belt 8 as the cleaning target and the cleaning brush roller that is the cleaning member that is disposed at the downstream side of the polarity control unit in the surface moving direction of the intermediate transfer belt 8, receives a voltage having the polarity reverse to the charging polarity of the toner controlled by the polarity control unit, and electrostatically removes the toner, may have a structure that includes the pre-cleaning brush roller 101 as the pre-cleaning member that is disposed at the upstream side of the polarity control unit in the surface moving direction of the intermediate transfer belt 8, receives a voltage having the polarity reverse to the normal charging polarity of the toner, and electrostatically removes the toner having the normal charging polarity.

Through this configuration, when the non-transferred toner image having a large amount of toner charged to the normal charging polarity is input to the belt cleaning apparatus 100, the toner, charged to the normal charging polarity, of the non-transferred toner image can be roughly removed by the pre-cleaning brush roller 101. Therefore, the amount of toner to be input to the polarity control unit disposed at the downstream side of the pre-cleaning brush roller 101 in the belt moving direction is reduced. As a result, the charging polarity of the toner on the intermediate transfer belt 8 can be effectively controlled by the polarity control unit. Therefore, the charging polarity of the toner to be input to the cleaning brush roller disposed at the downstream side of the polarity control unit in the belt moving direction can be adjusted. Since the amount of toner to be input to the cleaning brush roller is small, the toner on the intermediate transfer belt that cannot be removed by the pre-cleaning brush roller can be effectively removed by the cleaning brush roller. As a result, even though the non-transferred toner image is input to the belt cleaning apparatus, the non-transferred toner image can be effectively removed from the intermediate transfer belt.

Further, of the reversely-charged toner cleaning brush roller 104 and the normally-charged toner cleaning brush roller 107, the reversely-charged toner cleaning brush roller 104 disposed at the upstream side in the surface moving direction of the intermediate transfer belt 8 electrostatically removes the toner while applying charges having the same polarity as the normal charging polarity to the toner on the intermediate transfer belt 8. Thus, the toner of the intermediate transfer belt 8 to be input to the normally-charged toner cleaning brush roller 107 can be adjusted to the normal charging polarity. As a result, the toner on the intermediate transfer belt that passed through the reversely-charged toner cleaning brush roller can be electrostatically absorbed into and removed by the normally-charged toner cleaning brush roller 107 with the high degree of certainty.

Further, according to the belt cleaning apparatus of the first modified exemplary embodiment, the reversely-charged toner cleaning brush roller 104 rotates to move its surface in a direction reverse to the belt moving direction at the abutting position on the intermediate transfer belt 8. A center of the brush nip that is the abutting area of the reversely-charged toner cleaning brush roller 104 on the intermediate transfer belt in the belt moving direction is positioned at the downstream side of a center of the belt moving direction of the facing nip that is a stretching area of the cleaning facing roller 14 as the cleaning member facing roller in the belt moving direction. Through this arrangement, discharging easily occurs at the upstream side of the brush nip. At the upstream side of the brush nip, the toner adhered to the reversely-charged toner cleaning brush roller 104 and the toner carried on the intermediate transfer belt are present, and a large amount of toner is present. Therefore, the reversely-charged toner cleaning brush roller 104 and the cleaning facing roller 14 are disposed in an arrangement relationship in which discharging easily occurs at the upstream side of the brush nip. This allows discharging to actively occur at the upstream side of the brush nip, so that a large amount of toner can be polarity-controlled to the normal charging polarity. Therefore, the toner of the intermediate transfer belt 8 to be input to the normally-charged toner cleaning brush roller 107 can be adjusted to the normal charging polarity with the high degree of certainty. Accordingly, the toner on the intermediate transfer belt that passed through the reversely-charged toner cleaning brush roller can be electrostatically absorbed into and removed by the normally-charged toner cleaning brush roller 107 with the high degree of certainty.

Further, according to the belt cleaning apparatus of the first modified exemplary embodiment, the normally-charged toner cleaning brush roller 107 rotates to move its surface in a direction reverse to the belt moving direction at the abutting position on the intermediate transfer belt 8. A center of the brush nip that is the abutting area of the normally-charged toner cleaning brush roller 107 on the intermediate transfer belt in the belt moving direction is positioned at the upstream side of a center of the belt moving direction of the facing nip that is a stretching area of the cleaning facing roller 15 as the cleaning member facing roller in the belt moving direction. Through this arrangement, discharging easily occurs at the downstream side of the brush nip. At the downstream side of the brush nip, the toner is hardly adhered to the brush. Therefore, even though discharging occurs at the downstream side of the brush nip, the toner adhered to the brush roller is converted to the same polarity as the voltage applied to the brush roller and is hardly fallen from the brush roller. The toner that is fallen from the normally-charged toner cleaning brush roller 107 and passes through the normally-charged toner cleaning brush roller 107 can be almost removed, leading to the excellent cleaning characteristic.

Further, in the first modified exemplary embodiment, the reversely-charged toner cleaning brush roller 104 was disposed at the upstream side of the normally-charged toner cleaning brush roller 107 in the intermediate transfer belt moving direction. Since the toner is easily charged to the normal charging polarity, by disposing the reversely-charged toner cleaning brush roller 104 at the upstream side of the normally-charged toner cleaning brush roller 107 in the intermediate transfer belt moving direction, compared to an arrangement relationship reverse thereto, polarity control of controlling to the polarity reverse to the polarity of the voltage applied to the cleaning brush roller at the downstream side through the cleaning brush roller at the upstream side can be easily performed. Therefore, the toner that could not be removed by the cleaning brush roller at the upstream side can be effectively removed by the cleaning brush roller at the downstream side.

Further, according to the belt cleaning apparatus of the first modified exemplary embodiment, the pre-cleaning brush roller 101 rotates to move its surface in a direction reverse to the belt moving direction at the abutting position on the intermediate transfer belt 8. A center of the brush nip that is the abutting area of the pre-cleaning brush roller 101 on the intermediate transfer belt in the belt moving direction is positioned at the upstream side of a center of the belt moving direction of the facing nip that is a stretching area of the cleaning facing roller 13 as the cleaning member facing roller in the belt moving direction. Through this arrangement, discharging easily occurs at the downstream side of the brush nip. Therefore, the toner that is fallen from the pre-cleaning brush roller 101 and passes through the pre-cleaning brush roller 101 can be removed, and the toner that could not be completely removed can be effectively removed by the cleaning brush roller at the downstream side.

In the image forming apparatus that forms an image on the recording paper as the recording material by finally transferring the toner image formed on the image carrier from the image carrier onto the recording material, the toner on the image carrier can be effectively cleaned by using the cleaning apparatus as a cleaning apparatus for cleaning the residual transfer toner remaining on the image carrier after transfer. Therefore, high-quality image formation can be realized.

Further, by using the cleaning apparatus of the present invention as the belt cleaning apparatus 100 for cleaning the toner on the intermediate transfer belt 8 that is the image carrier, the toner on the intermediate transfer belt 8 can be effectively cleaned. Since the toner on the intermediate transfer belt 8 can be effectively cleaned, high-quality image formation can be realized.

Further, as illustrated in FIG. 12, by using the cleaning apparatus of the present invention as the conveying belt cleaning apparatus 500 for cleaning the residual toner on the conveying belt for conveying the recording paper, the toner on the paper conveying belt 51 can be effectively cleaned. Therefore, the back surface of the recording paper can be prevented from being contaminated by the toner.

According to the present invention, the non-transferred toner and the residual transfer toner can be effectively removed from the cleaning target.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A cleaning apparatus, comprising:

a normally-charged toner cleaning member that receives a voltage having a polarity reverse to a normal charging polarity of a toner and electrostatically removes a toner having the normal charging polarity on a cleaning target;

a reversely-charged toner cleaning member that receives a voltage having the same polarity as the normal charging polarity of a toner and electrostatically removes a toner having a polarity reverse to the normal charging polarity on the cleaning target; and a pre-cleaning member that is disposed at an upstream side of the normally-charged toner cleaning member and the reversely-charged toner cleaning member in a surface moving direction of the cleaning target, receives a voltage having a polarity reverse to the normal charging polarity of the toner, and electrostatically removes a toner having the normal charging polarity on the cleaning target, wherein the normally-charged toner cleaning member, the reversely-charged toner cleaning member, and the pre-cleaning member each includes a cleaning brush roller.

2. A cleaning apparatus, comprising:

a polarity control unit that controls a charging polarity of a toner on a cleaning target;

a cleaning member that is disposed at a downstream side of the polarity control unit in a surface moving direction of the cleaning target, receives a voltage having a polarity reverse to the charging polarity of the toner controlled by the polarity control unit, and electrostatically removes the toner; and a pre-cleaning member that is disposed at an upstream side of the polarity control unit in the surface moving direction of the cleaning target, receives a voltage having a polarity reverse to the normal charging polarity of the toner, and electrostatically removes a toner having the normal charging polarity, wherein the polarity control unit, the cleaning member, and the pre-cleaning member each includes a cleaning brush roller.

3. The cleaning apparatus according to claim 2, wherein the cleaning target is a belt member that is stretched over a plurality of stretching rollers, a cleaning member facing roller that is positioned at a position facing the cleaning member via the belt member and abuts on a back surface of the belt member to stretch a belt is disposed, the cleaning member is a roller member that abuts on a stretching area of the cleaning member facing roller on the belt member from a belt surface side and rotates to move on a surface thereof in a direction reverse to the belt moving direction at an abutting position, the stretching area of the cleaning member facing roller being an arc-shaped portion of the cleaning member facing roller which is wounded by the belt member, and a center of an abutting area of the cleaning member on the belt member in the belt moving direction is positioned at an upstream side of a center of the stretching area of the cleaning member facing roller in the belt moving direction.

4. The cleaning apparatus according to claim 2, wherein cleaning brush rollers are used as the cleaning member and the pre-cleaning member.

5. The cleaning apparatus according to claim 1, wherein, one of the reversely-charged toner cleaning member and the normally-charged toner cleaning member is an upstream side cleaning member that is disposed at a most upstream side of the cleaning apparatus in a cleaning target moving direction and electrostatically removes a toner while applying charges having the same polarity as a polarity of a voltage applied to the cleaning member to a toner on the cleaning target.

6. The cleaning apparatus according to claim 5, wherein the cleaning target is a belt member that is stretched over a plurality of stretching rollers, a cleaning member facing roller that is positioned at a position facing the upstream side cleaning member via the belt member and abuts on a back surface of the belt member to stretch a belt is disposed, the upstream side cleaning member is a roller member that abuts on a stretching area of the cleaning member facing roller on the belt member from a belt surface side and rotates to move on a surface thereof in a direction reverse to the belt moving direction at an abutting position, the stretching area of the cleaning member facing roller being an arc-shaped portion of the cleaning member facing roller which is wounded by the belt member, and a center of an abutting area of the upstream side cleaning member on the belt member in the belt moving direction is positioned at a downstream side of a center of the stretching area of the cleaning member facing roller in the belt moving direction.

7. The cleaning apparatus according to claim 1, wherein the cleaning target is a belt member that is stretched over a plurality of stretching rollers, a cleaning member facing roller that is positioned at a position facing a downstream side cleaning member, of the reversely-charged toner cleaning member and the normally-charged toner cleaning member, disposed at a downstream side of the surface moving direction of the cleaning target via the belt member and abuts on a back surface of the belt member to stretch a belt is disposed, the downstream side cleaning member is a roller member that abuts on a stretching area of the cleaning member facing roller on the belt member from a belt surface side and rotates to move on a surface thereof in a direction reverse to the belt moving direction at an abutting position, the stretching area of the cleaning member facing roller being an arc-shaped portion of the cleaning member facing roller which is wounded by the belt member, and a center of an abutting area of the downstream side cleaning member on the belt member in the belt moving direction is positioned at an upstream side of a center of the stretching area of the cleaning member facing roller in the belt moving direction.

8. The cleaning apparatus according to claim 5, wherein the reversely-charged toner cleaning member is disposed an upstream side of the normally-charged toner cleaning member in the surface moving direction of the cleaning target.

9. The cleaning apparatus according to claim 1, wherein the cleaning target is a belt member that is stretched over a plurality of stretching rollers, a pre-cleaning member facing roller that is positioned at a position facing the pre-cleaning member via the belt member and abuts on a back surface of the belt member to stretch a belt is disposed, the pre-cleaning member is a roller member that abuts on a stretching area of the pre-cleaning member facing roller on the belt member from a belt surface side and rotates to move on a surface thereof in a direction reverse to the belt moving direction at an abutting position, the stretching area of the pre-cleaning member facing roller being an arc-shaped portion of the cleaning member facing roller which is wounded by the belt member, and a center of an abutting area of the cleaning member on the belt member in the belt moving direction is positioned at an upstream side of a center of the stretching area of the pre-cleaning member facing roller in the belt moving direction.

10. The cleaning apparatus according to claim 2, wherein the cleaning target is a belt member that is stretched over a plurality of stretching rollers, a pre-cleaning member facing roller that is positioned at a position facing the pre-cleaning member via the belt member and abuts on a back surface of the belt member to stretch a belt is disposed, the pre-cleaning member is a roller member that abuts on a stretching area of the pre-cleaning member facing roller on the belt member from a belt surface side and rotates to move on a surface thereof in a direction reverse to the belt moving direction at an abutting position, the stretchin area of the re-cleaning member facing roller being an arc-shaped portion of the cleaning member facing roller which is wounded by the belt member, and a center of an abutting area of the cleaning member on the belt member in the belt moving direction is positioned at an upstream side of a center of the stretching area of the pre-cleaning member facing roller in the belt moving direction.

11. An image forming apparatus that forms an image on a recording material by finally transferring a toner image formed on an image carrier from the image carrier to the recording material, comprising:

the cleaning apparatus according to claim 1 or 2 is used as a cleaning apparatus for cleaning a residual transfer toner remaining on the image carrier after a transfer.

12. The cleaning apparatus according to claim 1, further comprising:

a reversely-charged toner collecting member which collects the toner adhered to the cleaning roller brush of the reversely-charged toner cleaning member, and a reversely-charged toner scraping member which abuts the reversely-charged toner collecting member and scrapes a rolling surface of the reversely-charged toner collecting member.

13. The cleaning apparatus according to claim 2, further comprising:

a reversely-charged toner collecting member which collects the toner adhered to the cleaning roller brush of the polarity control unit, and a reversely-charged toner scraping member which abuts the reversely-charged toner collecting member and scrapes a rolling surface of the reversely-charged toner collecting member.

14. The cleaning apparatus according to claim 1, wherein the cleaning brush roller includes a metal rotation shaft member and a plurality of bristles erected on a peripheral surface of the metal rotation shaft member.

15. The cleaning apparatus according to claim 2, wherein the cleaning brush roller includes a metal rotation shaft member and a plurality of bristles erected on a peripheral surface of the metal rotation shaft member.

* * * * *